US007913983B1

(12) United States Patent
Sandor, Sr.

(10) Patent No.: US 7,913,983 B1
(45) Date of Patent: Mar. 29, 2011

(54) STAIR, RAMP, OR BALCONY RAILING SYSTEM

(76) Inventor: Frederick J. Sandor, Sr., Satellite Beach, FL (US)

( * ) Notice: Subject to any disclaimer, the term of this patent is extended or adjusted under 35 U.S.C. 154(b) by 0 days.

(21) Appl. No.: 11/598,266

(22) Filed: Nov. 13, 2006

(51) Int. Cl.
*E04H 17/14* (2006.01)

(52) U.S. Cl. ..... 256/67; 256/55; 256/60; 256/69; 256/65.12

(58) Field of Classification Search ..... 256/19, 256/21, 22, 54, 55, 56, 59, 65.02, 60, 65.11, 256/67, 65.12, 68, 69, 70, DIG. 5; 403/90, 403/123; 411/338
See application file for complete search history.

(56) References Cited

U.S. PATENT DOCUMENTS

| | | | | | |
|---|---|---|---|---|---|
| 191,944 | A | * | 6/1877 | Dewey | 256/59 |
| 210,526 | A | | 12/1878 | Hanson | |
| 250,046 | A | * | 11/1881 | Rogers | 256/22 |
| 263,324 | A | * | 8/1882 | Devoe | 256/22 |
| 351,194 | A | * | 10/1886 | McDougall | 256/52 |
| 372,254 | A | * | 10/1887 | Cooper | 256/22 |
| 1,084,850 | A | * | 1/1914 | Ford | 411/338 |
| 1,234,674 | A | * | 7/1917 | Lachman | 256/22 |
| 1,297,838 | A | * | 3/1919 | Haines | 256/32 |
| 1,772,159 | A | | 8/1930 | Roth | |
| 1,776,517 | A | * | 9/1930 | MacDonald | 256/13.1 |
| 2,669,434 | A | * | 2/1954 | White | 256/59 |
| 3,352,541 | A | * | 11/1967 | Thom | 256/21 |
| 3,604,686 | A | * | 9/1971 | Parisien | 256/32 |
| 4,193,229 | A | * | 3/1980 | Hartman | 256/67 |
| 4,408,749 | A | | 10/1983 | Zieg | |
| 5,496,016 | A | * | 3/1996 | Parisien | 256/68 |
| 6,145,814 | A | | 11/2000 | Perrot | |
| 6,299,143 | B1 | | 10/2001 | Valentine | |

* cited by examiner

*Primary Examiner* — Michael P Ferguson
(74) *Attorney, Agent, or Firm* — Mayback & Hoffman, P.A.; Gregory L. Mayback; Katie M. Blakley

(57) ABSTRACT

In a preferred embodiment, an apparatus, including: a plurality of members disposed inside generally vertical balusters; each of the members having formed therethrough a hole; a plurality of wires, cables, rods, pipes, tubes (round, oval, or multi-sided) or the like, each one disposed through one of the holes; and the members being rotatable to position the wires, cables, rods, pipes, tubes (round, oval, or multi-sided), or the like at a selected angle from horizontal.

12 Claims, 29 Drawing Sheets

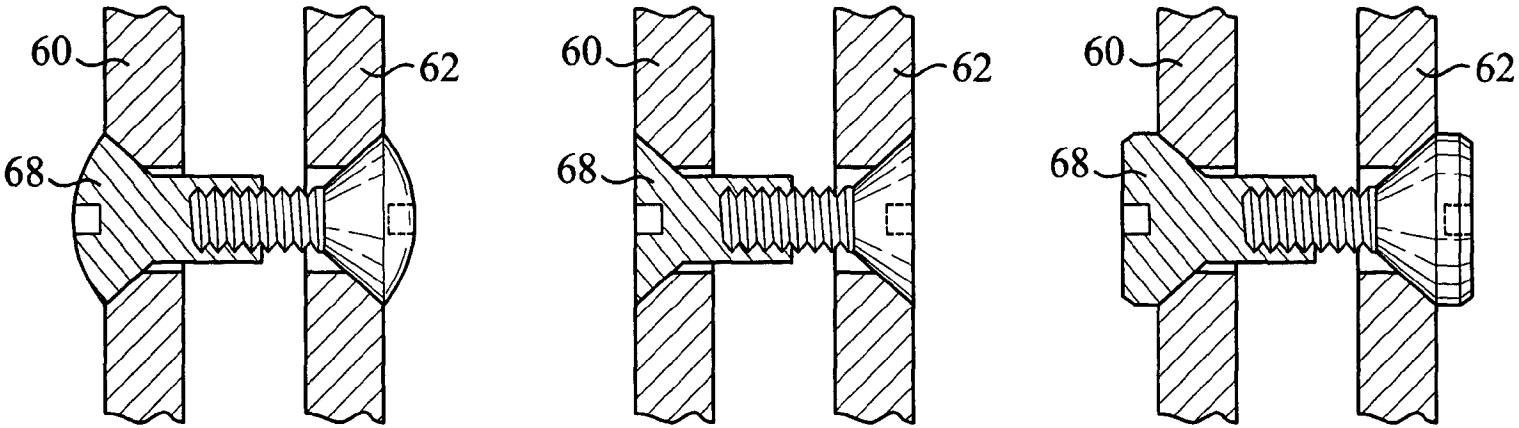
FIG. 16A
FIG. 16B
FIG. 16C
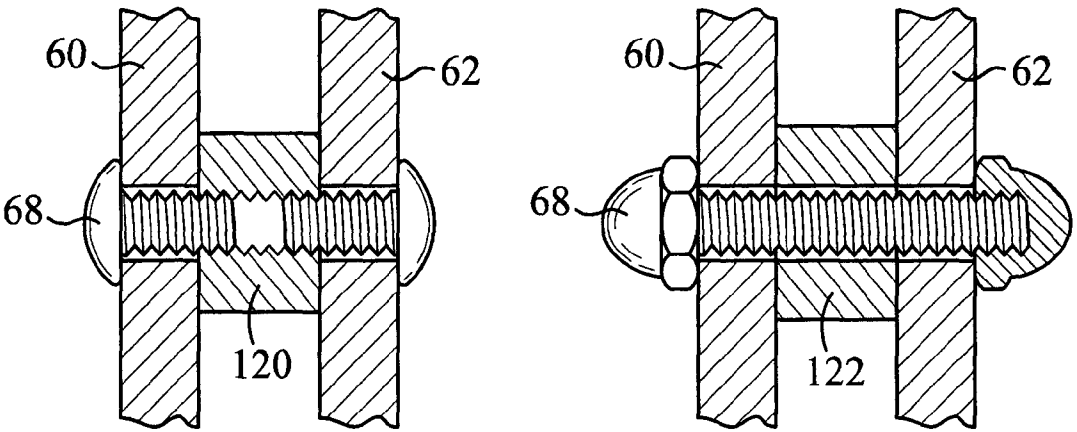
FIG. 16D
FIG. 16E

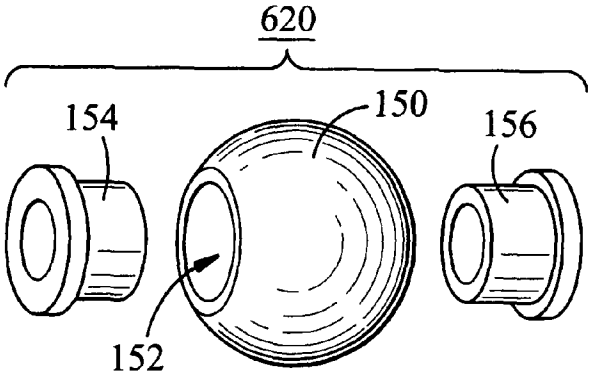
FIG. 18A
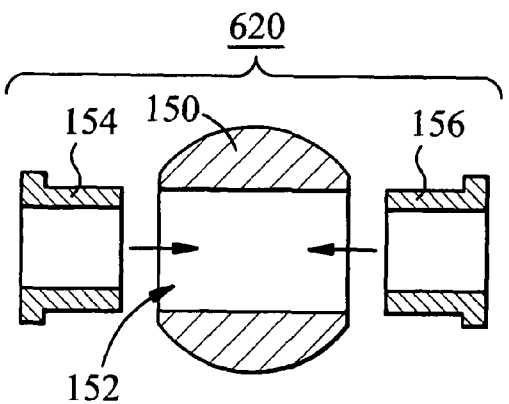
FIG. 18B
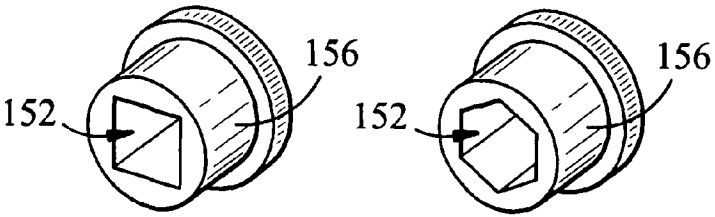
FIG. 18D
FIG. 18E
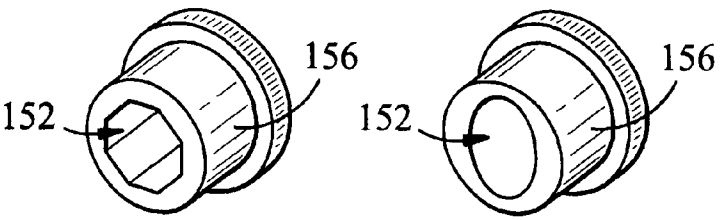
FIG. 18F
FIG. 18G
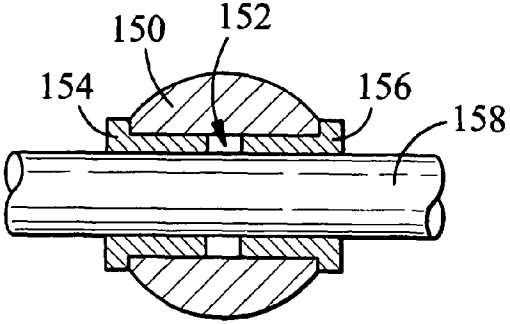
FIG. 18C

STAIR, RAMP, OR BALCONY RAILING SYSTEM

BACKGROUND OF THE INVENTION

1. Field of the Invention

The present invention relates to railings generally and, more particularly, but not by way of limitation, to a novel stair, ramp, or balcony railing system.

2. Background Art

Most current systems require posts or balusters to be accurately drilled at the proper angle and frequency required to achieve the desired spacing and slope. This is very difficult and expensive—requiring expertise and experience and expensive equipment.

Some attempts at providing a simplified railing system are as follows:

U.S. Pat. No. 210,526, issued Dec. 3, 1878, to Hanson, and titled IRON-FENCE, discloses an iron fence consisting of two channel-shaped railings with the tongues of cylindrical picket holding members inserted in the channels. Pickets are held externally in the cylindrical picket holding members.

U.S. Pat. No. 1,772,159, issued Aug. 5, 1930, to Roth, and titled RAIL CONNECTION, discloses in FIGS. 5 and 6 spheres mounted in the ends of balusters and attached to rails at any angle by means of screws passing through the rails and the spheres.

U.S. Pat. No. 4,408,749, issued Oct. 11, 1983, to Zieg, and titled VARIABLE PITCH RAILING AND SYSTEM, discloses a railing system in which the ends of balusters are fitted with segments of spheres. The segments of spheres fit into complementary shaped arcuate openings formed in the rails and the ends of the balusters are confined by elongated molding. Thus, the balusters can be rotated to almost any degree.

U.S. Pat. No. 6,145,814, issued Nov. 14, 2000, to Perrot, and titled DEVICE FOR MOUNTING HANDRAIL ELEMENT ON A POST IN PARTICULAR FOR PRODUCING A STAIRCASE AND A SET PROVIDED THEREFOR, discloses in pertinent aspects a railing system similar to that of the '749 patent above.

U.S. Pat. No. 6,299,143, issued Oct. 9, 2001, to Valentine, and titled COUPLING SPOOL, discloses a railing system in which a spool is slid internally of a rail until it is aligned with an opening formed in the rail. A picket is inserted into the spool and is attached to the spool by welding, bonding, or other attachment methods to secure the picket in the rail. The picket can then be rotated within the rail as guided by the spool.

All of the above are relatively complicated and/or expensive.

Accordingly, it is a principal object of the present invention to provide a railing system for stairs, ramps, or balconies that offers adjustable angle capability and ease of installation for, for example, wire, cable, pipe, rod, or the like.

It is a further object of the present invention to provide such a system that captures members of metal, plastic, glass, tubes (round, oval, or multi-sided), or composite, or the like at pre-determined spacing with holes formed in the members. The holes are of proper diameter to permit the members to pass therethrough with the members rotated as required to the desired slope.

It is an additional object of the invention to provide holes that are oversized with the desired hole diameter achieved with varying bushings.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing an apparatus, comprising: a plurality of members disposed inside generally vertical balusters; each said member having formed therethrough a hole; a plurality of wires, cables, rods, pipes, tubes (round, oval, or multi-sided), or the like, each one disposed through one of said holes; and said members being rotatable to position said wires, cables, rods, pipes, tubes (round, oval, or multi-sided), or the like at a selected angle from horizontal.

BRIEF DESCRIPTION OF THE DRAWING

Understanding of the present invention and the various aspects thereof will be facilitated by reference to the accompanying drawing figures, provided for purposes of illustration only and not intended to define the scope of the invention, on which:

FIGS. 16A-16E are fragmentary side elevational views showing various methods of clamping together baluster halves.

FIGS. 18A-18G show a ball with an oversized hole formed through the center thereof, the excess being taken up by bushings.

DETAILED DESCRIPTION OF THE PREFERRED EMBODIMENTS

Figure 1:
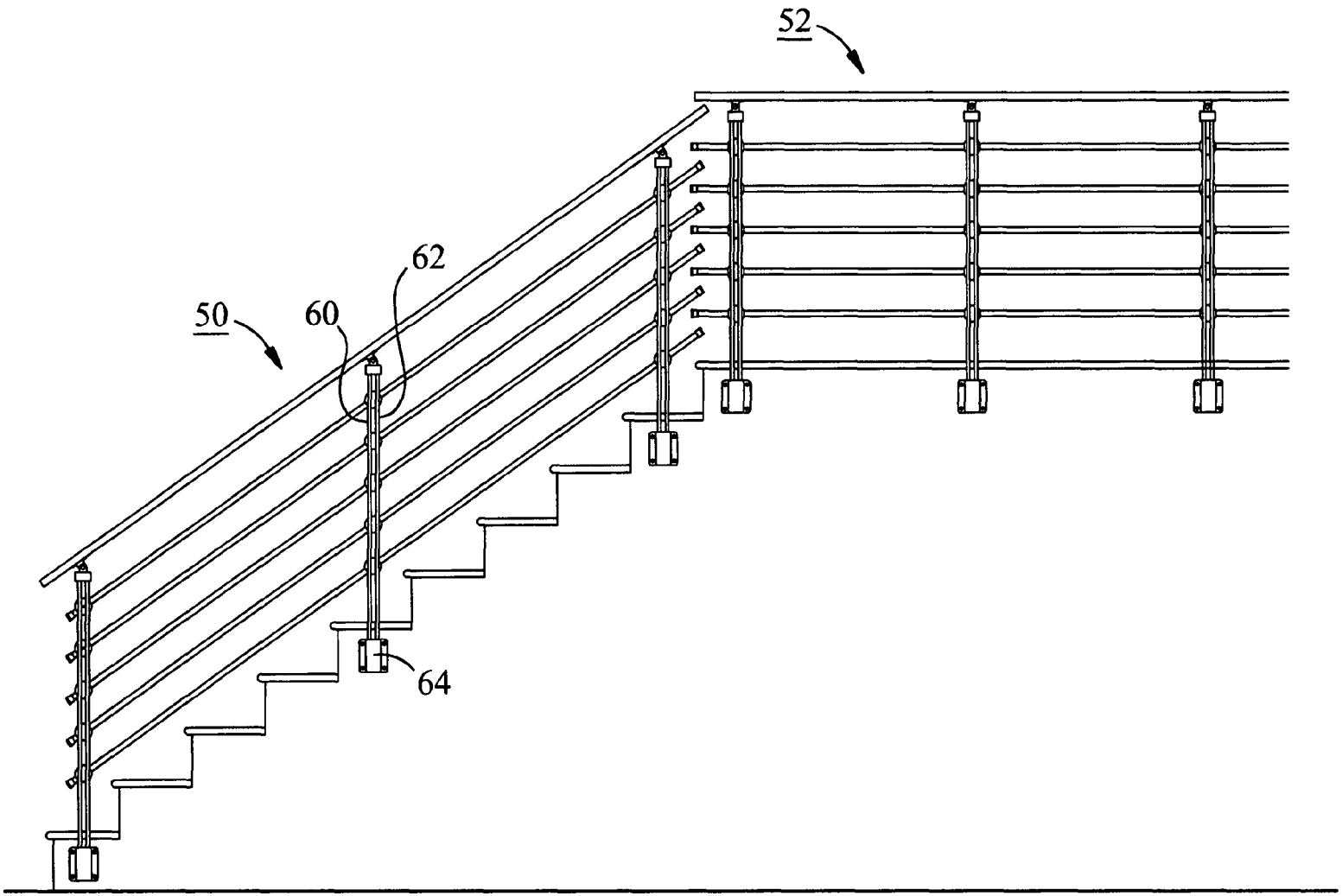
FIG. 1 is a side elevational view of a stair and balcony railing system, constructed according to the present invention, and showing a side mount version.

Reference should now be made to the drawing figures, provided for purposes of illustration only, and on which the figure numerals in parentheses (when used) refer the reader to the figure in which the element(s) being described are more fully shown, although the element(s) may be shown on other figures also.

FIG. 1 illustrates a stair railing and a balcony railing, constructed according to the present invention, and generally indicated, respectively by the reference numerals 50 and 52. Stair and balcony railings 50 and 52 are of the side mount type, that is, the halves, as at 60 and 62, of the generally vertical balusters thereof are inserted in brackets, as at 64, mounted on the generally vertical sides of the stairs and the balcony.

Figure 2:
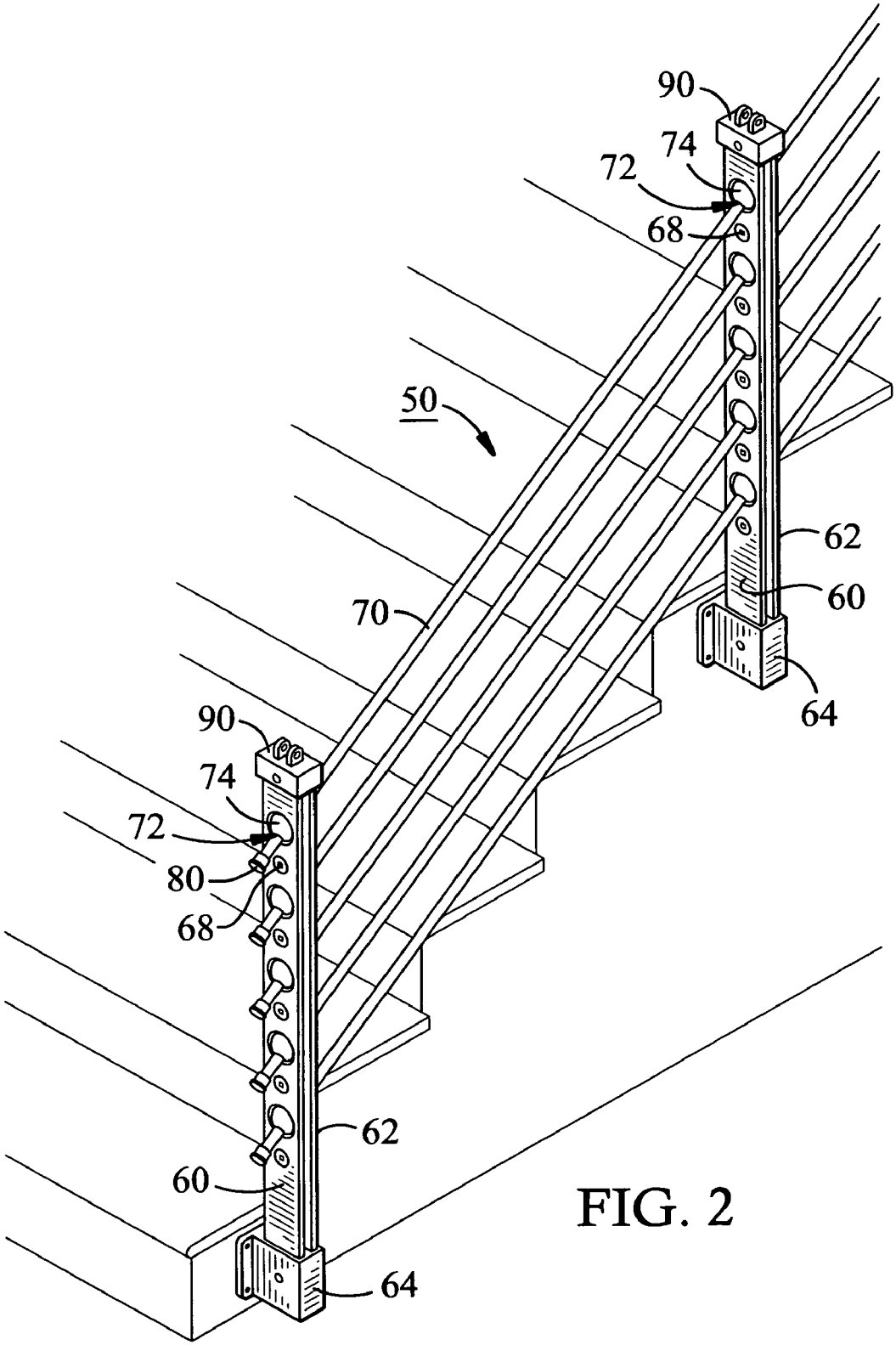
FIG. 2 is a fragmentary, isometric view of the stair portion of FIG. 1, without the handrail.

FIG. 2 illustrates the details of construction of railings 50, here, two halves 60 and 62 of balusters of stair railing 50, baluster halves 60 and 62 each having a contact face facing a respective contact face of the other baluster half when mounted within bracket 90, the contact faces extending transversely to the longitudinal extension of the wires, cables, rods, pipes or tubes 70. Wires, cables, rods, pipes, tubes, or the like, for example, as at 70, are inserted through centrally positioned holes, as at 72, formed in members, as at 74, and the members rotated to their desired positions. Baluster halves 60 and 62 can also be halves of square or rectangular stock. Baluster halves 60 and 62 are then squeezed together by clamping means, as at 68, preventing members 74 from rotating further, thus fixing the members in their desired positions. Members 74 can be steel, stainless steel, aluminum, carbon fiber, or any suitable material. Baluster halves 60 and 62 can be steel, stainless steel, aluminum, glass, plastic, carbon fiber, or any suitable material. Holes 72 may be drilled, punched, stamped, etc. Caps or plugs, as at 80, may be provided on the ends of the wires, cables, rods, pipes, tubes, or the like 70. Brackets 90 are provided at the upper ends of baluster halves 60 and 62 for attached thereto of handrails (not shown on FIG. 2) as described infra.

Figure 3:
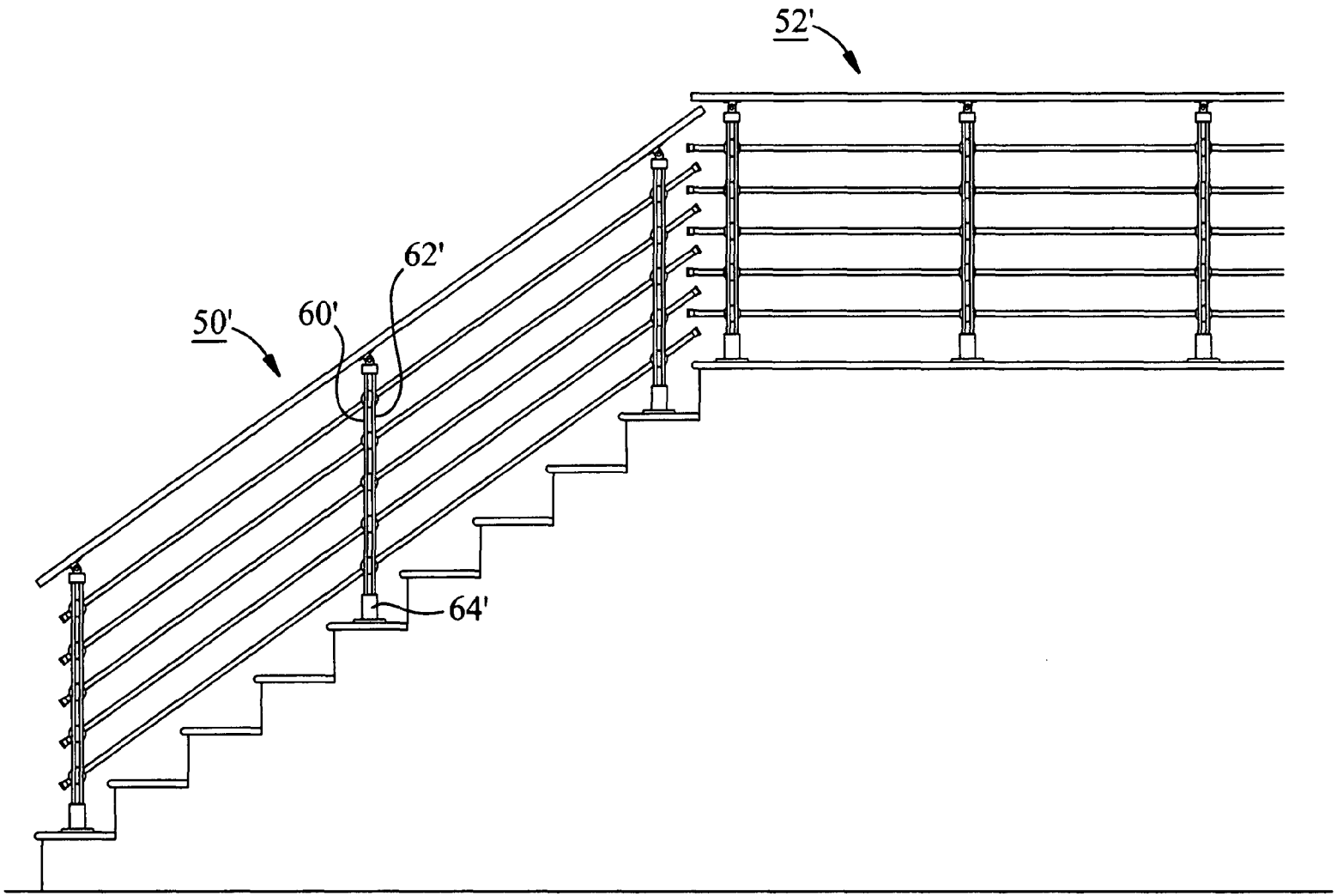
FIG. 3 is a side elevational view of a stair and balcony railing system, constructed accord to the present invention, and showing a surface mount version.

FIG. 3 illustrates a stair railing and a balcony railing, constructed according to the present invention, and generally indicated, respectively, by the reference numerals 50' and 52'. Elements of railings 50' and 52' having generally the same function as the elements of railings 50 and 52 (FIG. 1) are given primed reference numerals. The only difference between railings 50 and 52 and railings 50' and 52' is that the baluster halves of railings 50' and 52' are of the surface mount type, that is, the halves, as at 60 and 62, of the generally vertical balusters thereof are inserted in brackets, as at 64, mounted on the generally horizontal surfaces of the stairs and the balcony.

Figure 4:
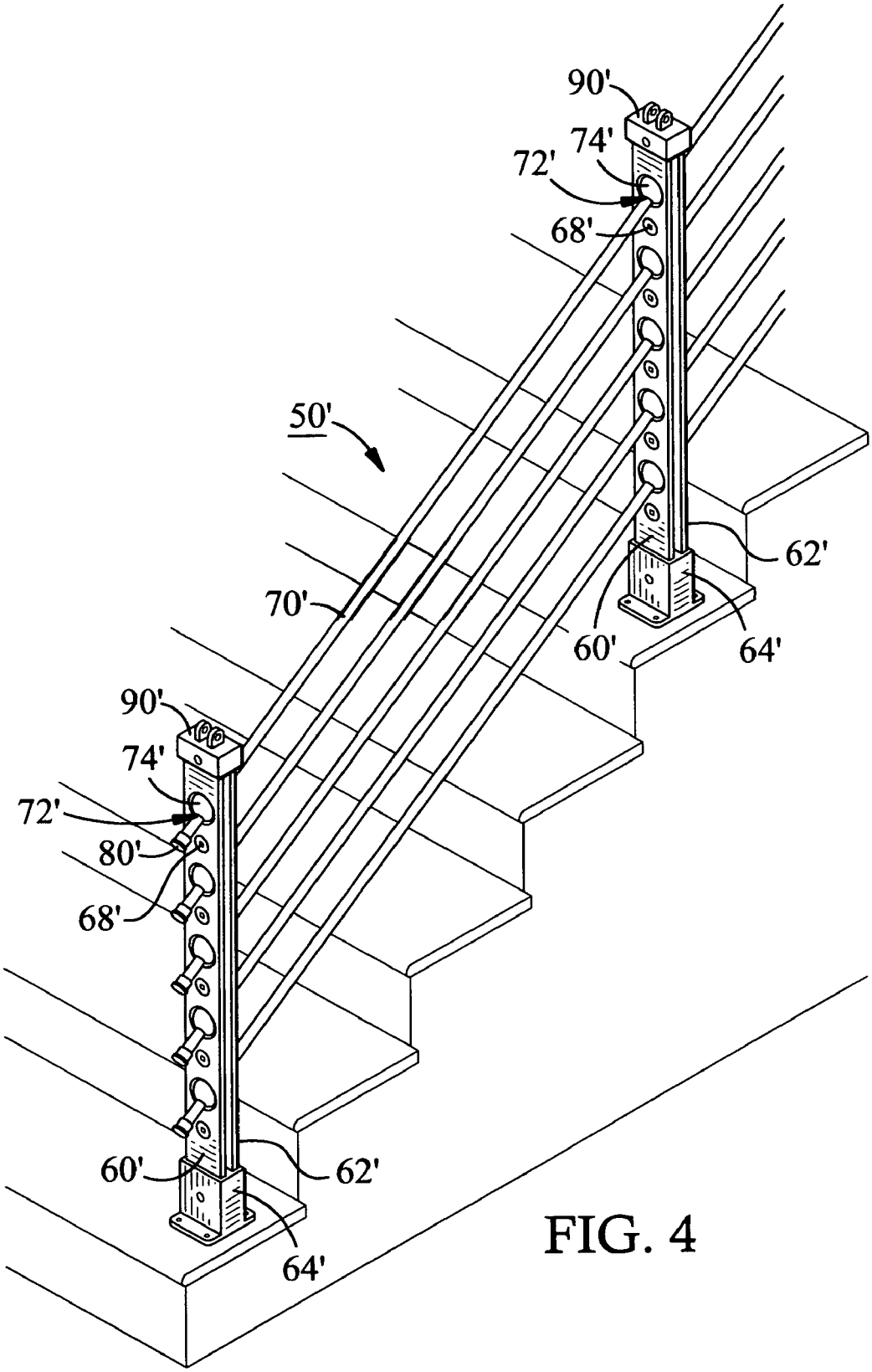
FIG. 4 is a fragmentary, isometric view of the stair portion of FIG. 3, without the handrail.

FIG. 4 illustrates the details of construction of railings 50' and 52', here, two balusters halves of railing 50' are inserted in surface mount 64'.

Figure 5:
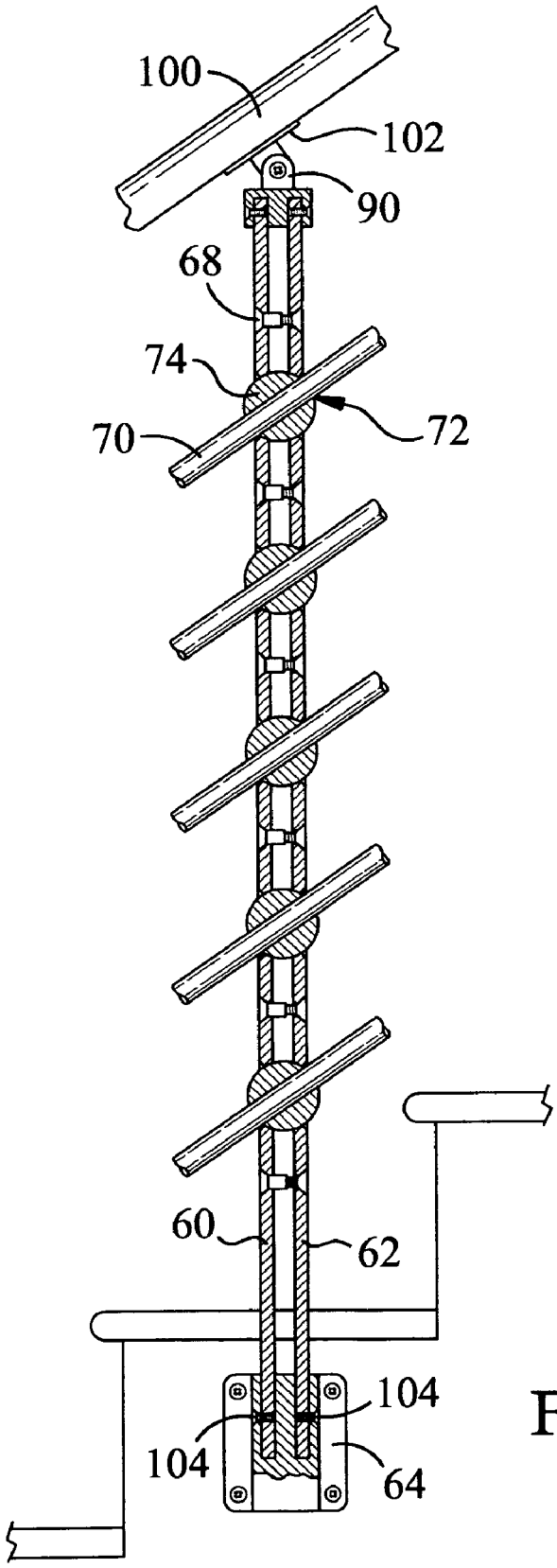
FIG. 5 is a side elevational view, partially in cross-section, of one stair baluster in side mount configuration.

FIG. 5 illustrates details of the construction of baluster halves 60 and 62 (FIG. 2) and shows that handrail 100 has been attached to bracket 90 by means of bracket 102 rotatably engaging bracket 100 and that the lower ends of the baluster halves are securely fastened to bracket 64 by means of two screws 104.

Figure 6:
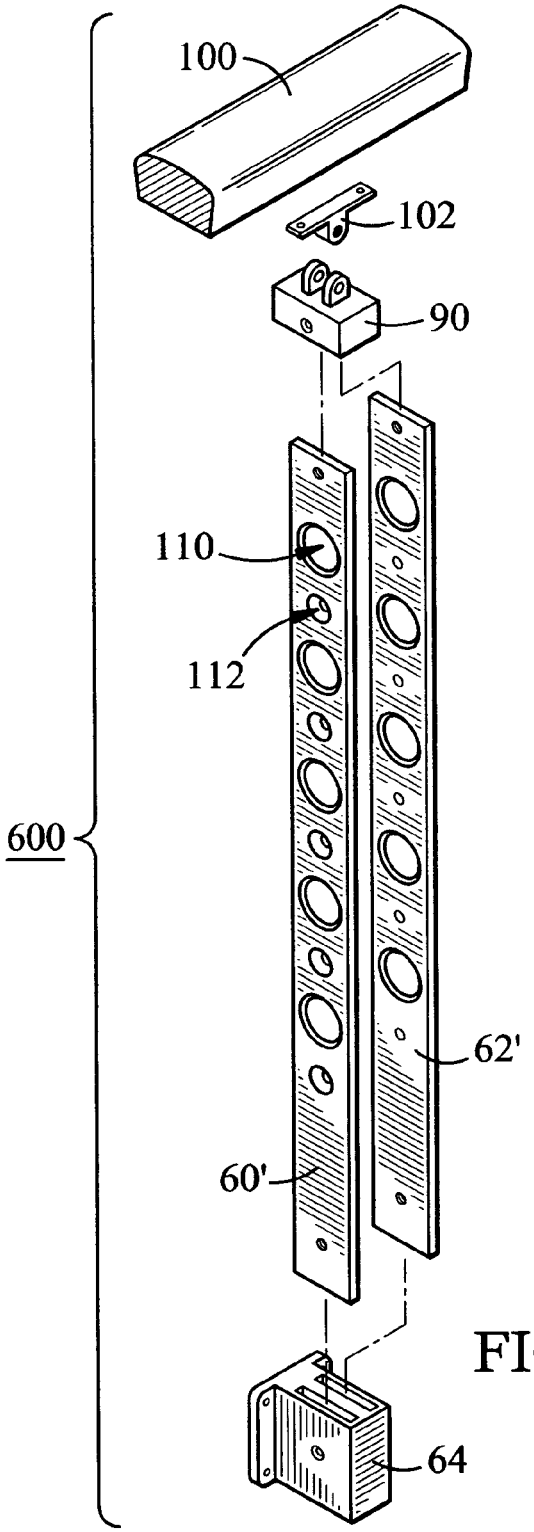
FIG. 6 is a fragmentary, exploded, isometric view of the baluster of FIG. 5.

FIG. 6 illustrates details of construction of baluster 600, with baluster halves 60 and 62 (FIG. 2) and shows holes, as at 110, for the partial protrusion of members 74 (FIG. 5) and holes, as at 112, for the insertion therein of clamping means 68.

Figure 7:
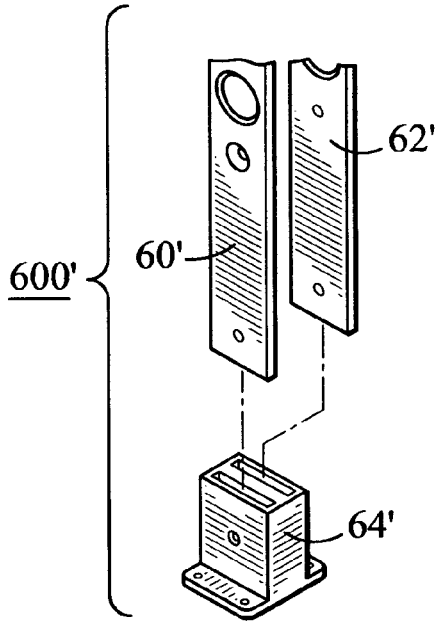
FIG. 7 is an isometric view, of the baluster of FIG. 6 in surface mount configuration.

FIG. 7 illustrates baluster halves 60' and 62' to be inserted in bracket 64'.

Figure 8A:
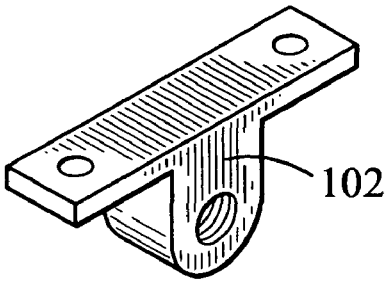
FIGS. 8A-9B are isometric views of a method of attachment of the handrail.
Figure 8B:
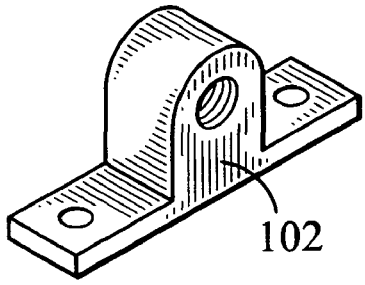
Figure 9A:
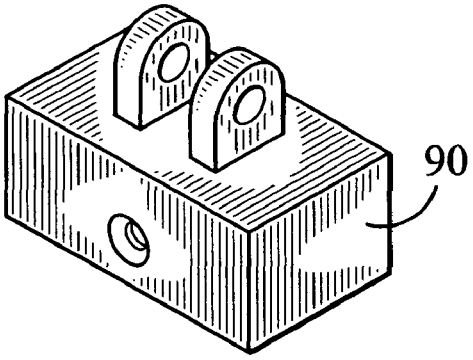
Figure 9B:
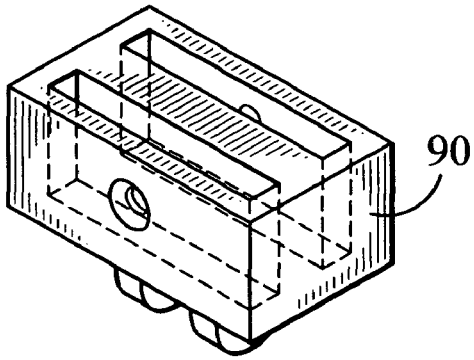
Figure 10:
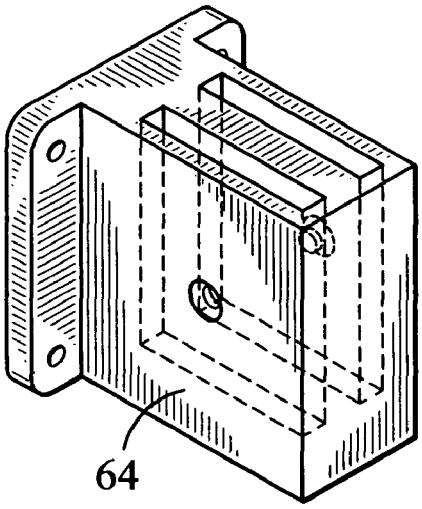
FIG. 10 is an isometric view of a side mount bracket.
Figure 11:
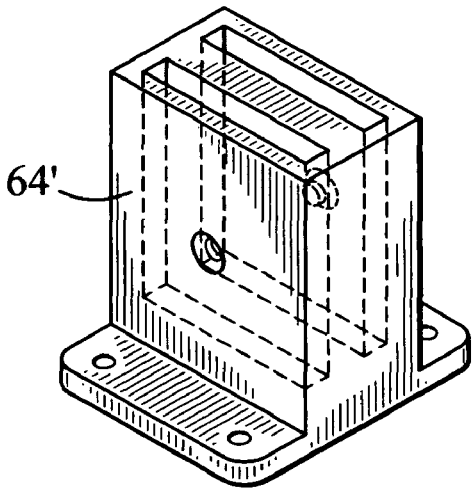
FIG. 11 is an isometric view of a surface mount bracket.

FIGS. 8A, 9A, 10, and 11 show brackets 102, 90, 64, and 64', respectively, in their upright positions, while FIGS. 8B and 9B show brackets 102 and 90, respectively, in their inverted positions.

Figure 12:
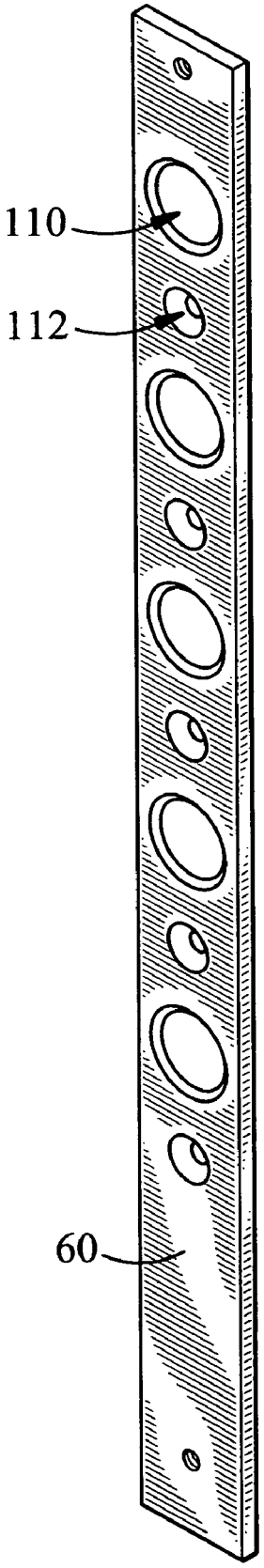
FIG. 12 is an isometric view of a baluster half.
Figure 13:
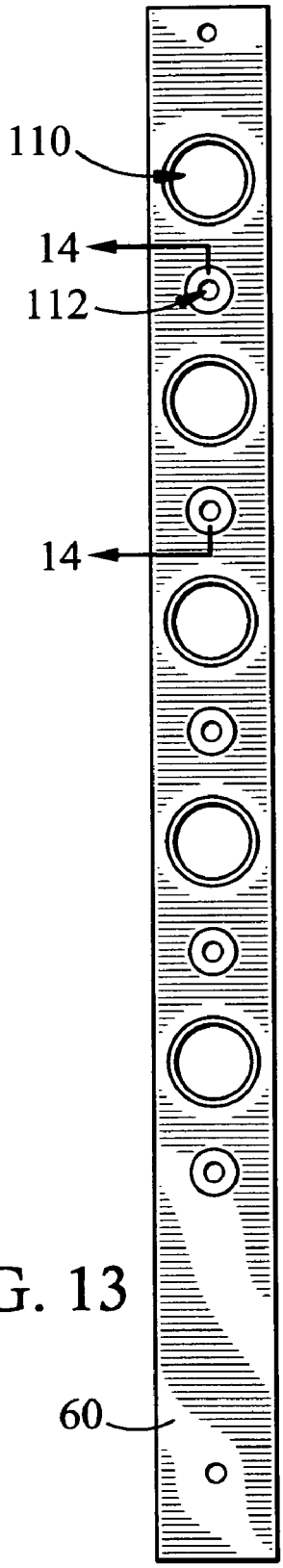
FIG. 13 is an end elevational view of a baluster half.

FIG. 12 illustrates an isometric view of baluster half 60, while FIG. 13 illustrates an end elevational view of the baluster half (both FIG. 5).

Figure 15:
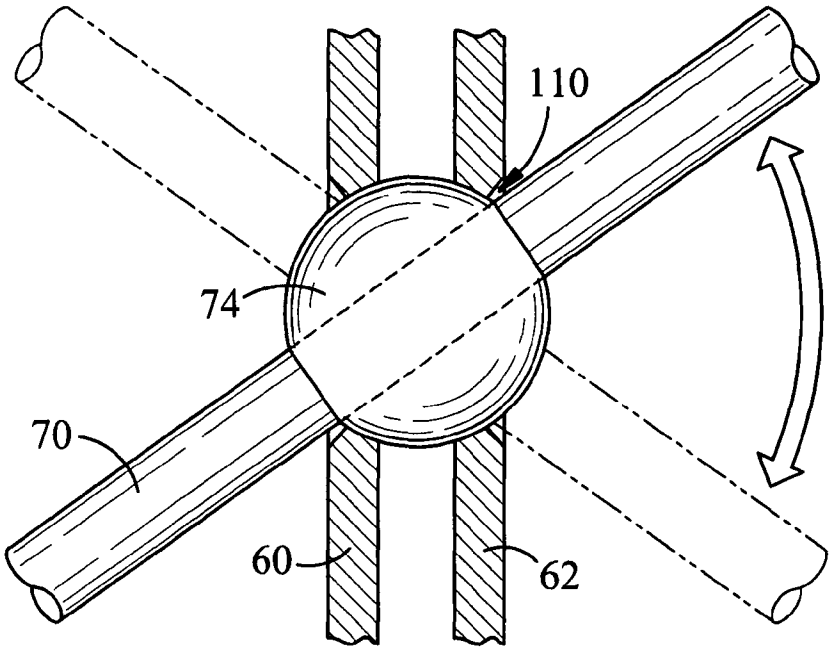
FIGS. 14 and 15 show the range of rotational motion achievable with the present invention, with FIG. 14 being taken along line "14-14" of FIG. 13.
Figure 14:
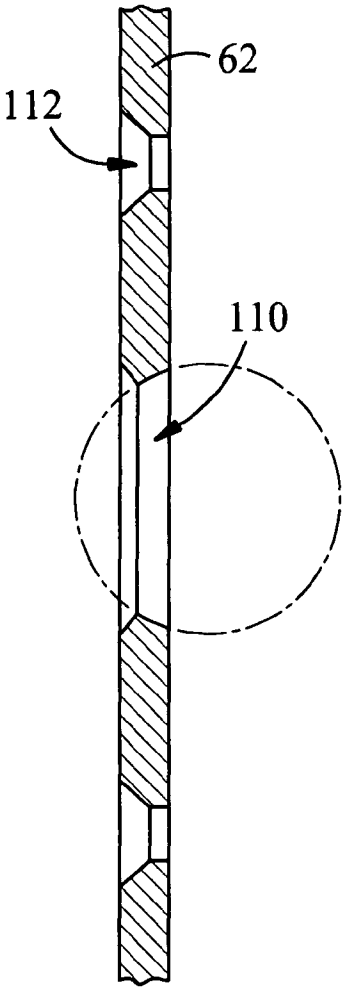

FIGS. 14 and 15 illustrate the range of rotation of member 74, which range of rotation is at least forty-five degrees in either direction from horizontal.

FIGS. 16A-16E illustrate various configurations clamping means 68 can take (FIG. 5). On FIGS. 16A-C no spacer is provided between baluster halves 60 and 62. On FIGS. 16D-16E, spacers 120 and 122, respectively, are provided between baluster halves 60 and 62. Clamping means can also be accomplished by welding, gluing, or other methods.

Figure 17A:
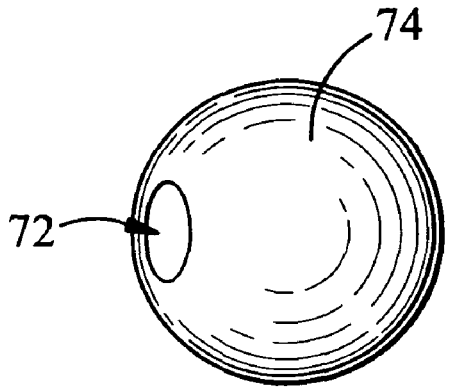
FIGS. 17A-17C show a ball with a hole formed through the center thereof.
Figure 17B:
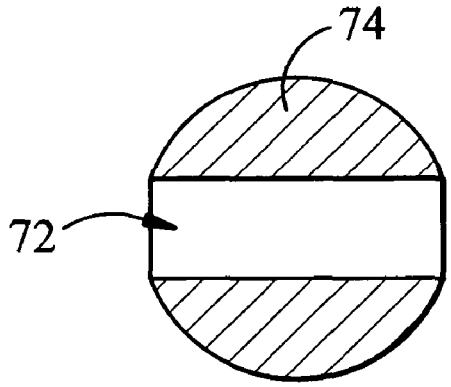
Figure 17C:
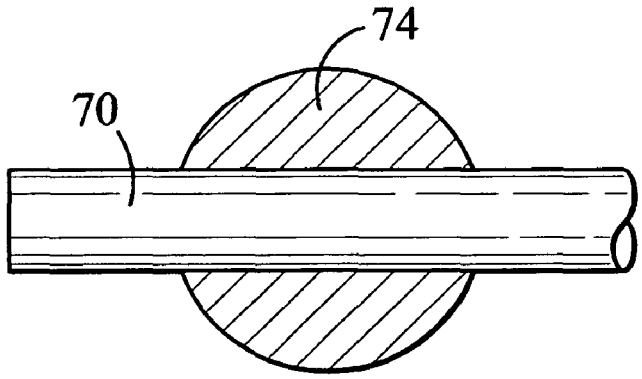

FIGS. 17A and 17B illustrate member 74 with a hole 72 formed therein (FIG. 5). FIG. 17C illustrates a wire, cable, rod, pipe, or the like inserted in hole 72 (FIGS. 17A and 17B).

FIGS. 18A-18G illustrate a spherical member 150 having a hole 152 formed therethrough and bushings 154 and 156 inserted in the ends of the hole, with a wire, cable, rod, tubing (round, oval, or multi-sided), or pipe 70 (FIG. 18G) inserted in the hole. This arrangement is used when the diameter of hole 152 is larger than the diameter of wire, cable, rod, pipe, tubing (round, oval, or multi-sided), or the like 70.

Figure 19:
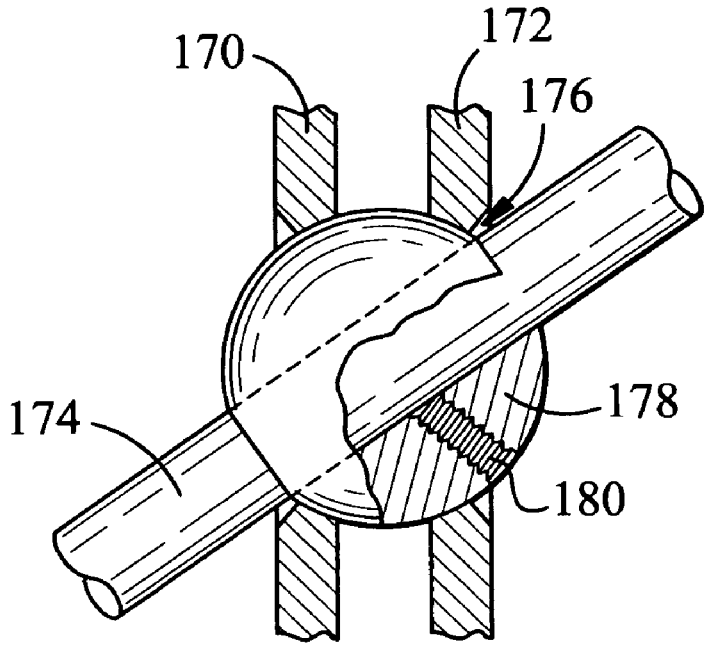
FIGS. 19 and 20 are fragmentary, side elevational view showing alternative methods of fixing a ball in place, the ball rotating between the halves of the balusters.

FIG. 19 illustrates baluster halves 170 and 172, with a wire, cable, rod, or pipe 174 inserted in a hole 176 formed in a spherical member 178. A set screw (not shown on FIG. 19) is advanced through spherical member 178 against wire, cable, rod, pipe, or the like 174 to secure the wire, cable, rod, pipe, or the like in place.

Figure 20:
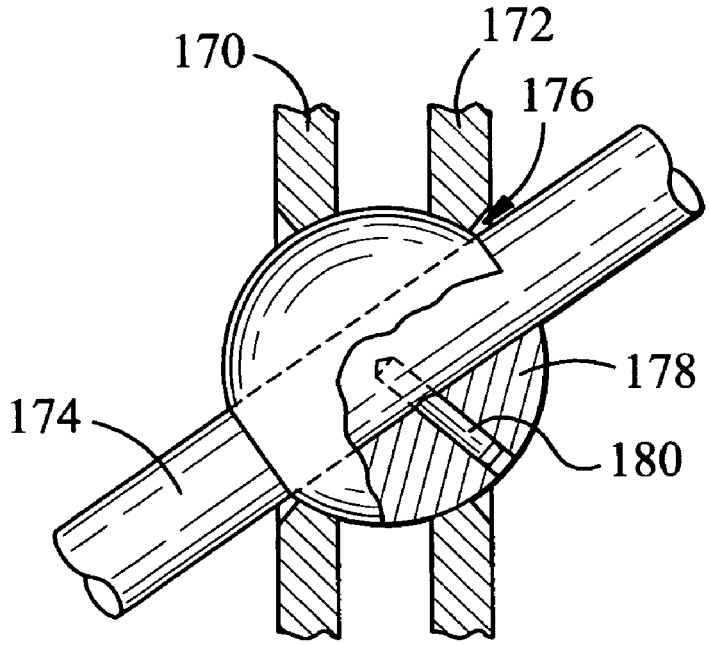

FIG. 20 illustrates baluster halves 170 and 172 as shown on FIG. 19, except that the set screw has been replaced with a pin 190, the function of pin 190 being the same as the set screw.

Figure 21:
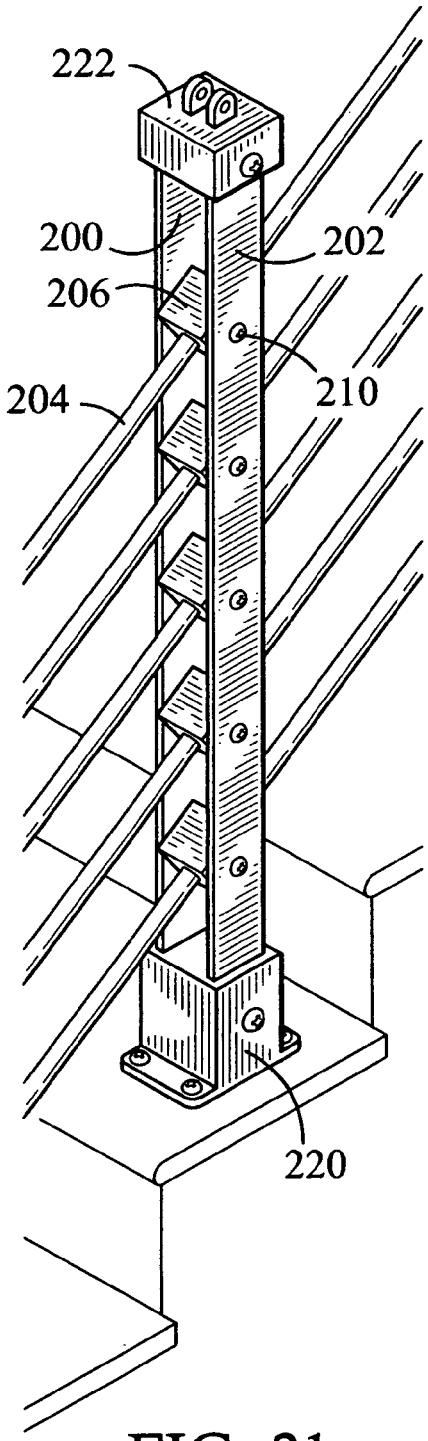
FIGS. 21 and 22 are fragmentary, isometric views showing alternative methods of fixing the members in place between two baluster halves, the baluster halves being of the surface mount configuration on a stair railing, the members comprising cylinders and squares.

FIG. 21 illustrates baluster halves 200 and 202 with a wire, cable, rod, or pipe 204 inserted through a hole formed in a square member 206. It will be noticed that baluster halves 200 and 202 are rotated ninety degrees from baluster halves 60' and 62' shown on FIG. 4 and that the baluster halves 200 and 202 are not squeezed together, but members 206 are free to rotate around a screw, as at 210. Generally vertical baluster halves 200 and 202 are fixed at their lower ends in a surface mount bracket 220 and have a bracket 222 for the attachment of a handrail (not shown on FIG. 21).

Figure 22:
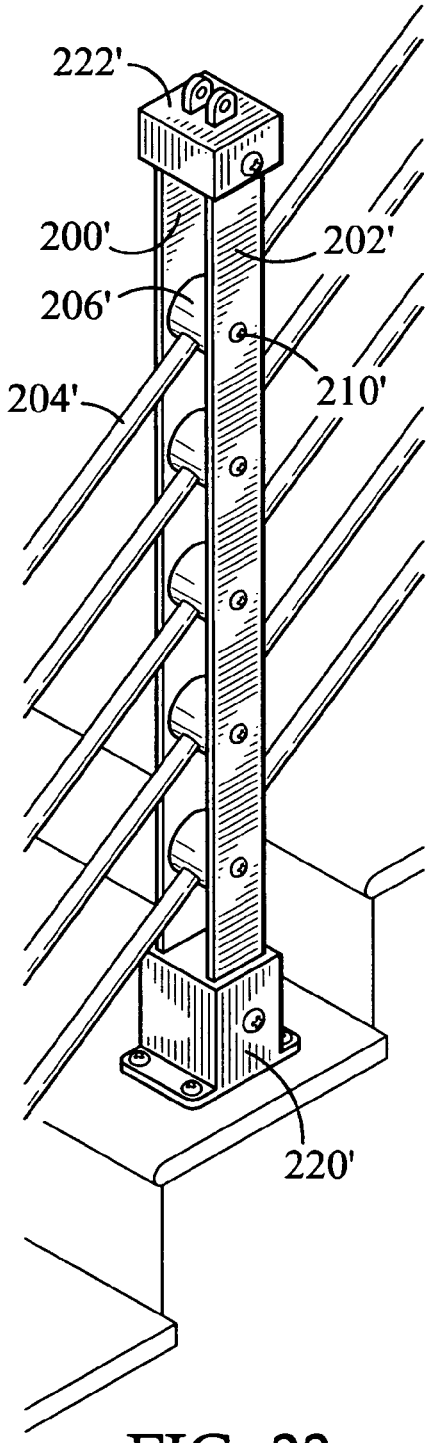

FIG. 22 illustrates baluster halves 200' and 202'. Elements of baluster halves 200' and 202' having generally the same function as the elements of baluster halves 200 and 202 (FIG. 21) are given primed reference numerals. The only difference between baluster halves 200 and 202 and railings 200' and 202' is that the baluster halves have therebetween cylindrical members 206' rather than square members 206.

Figure 23:
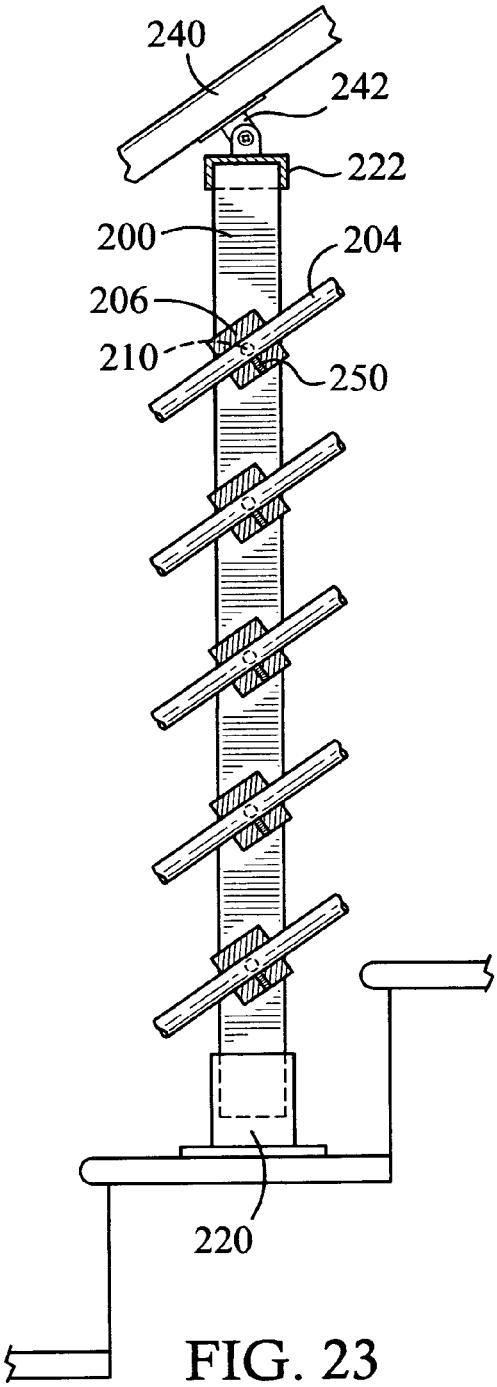
FIGS. 23 and 24 are fragmentary, side elevational view, partially in cross-section of the methods of FIGS. 19-22.

FIG. 23 is a side elevational view of FIG. 21 and further shows that handrail 240 has been attached by means of bracket 242 and that wire, cable, rod, pipe, or the like 204 is held securely in place by means of set screw 250.

Figure 24:
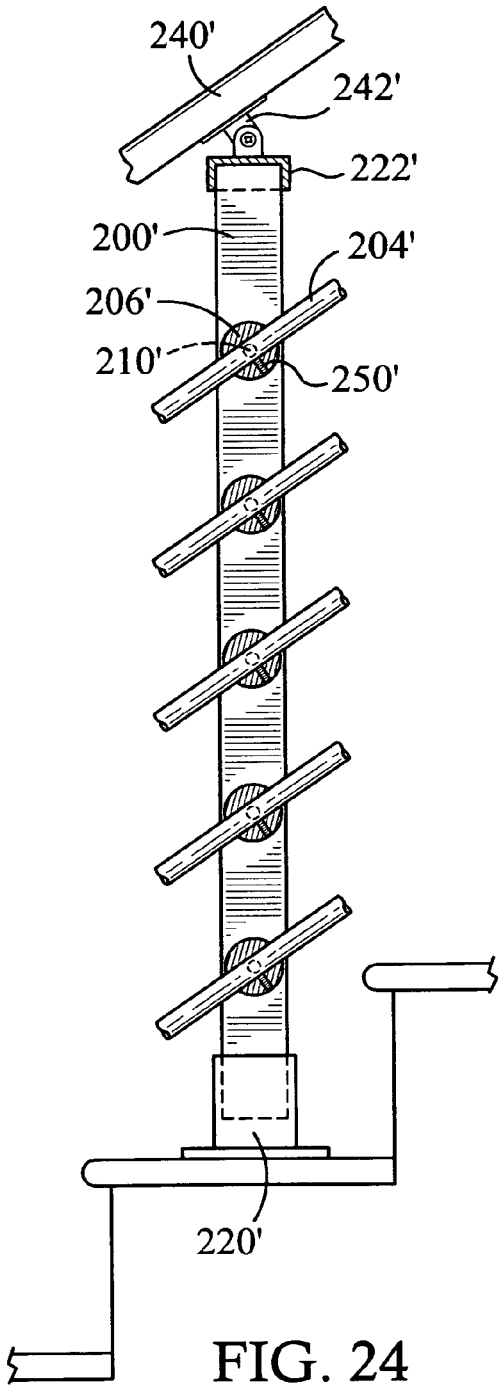

FIG. 24 is a side elevational view of FIG. 22. Elements of having generally the same function as the elements described with reference to FIG. 22 are given primed reference numerals.

Figure 26:
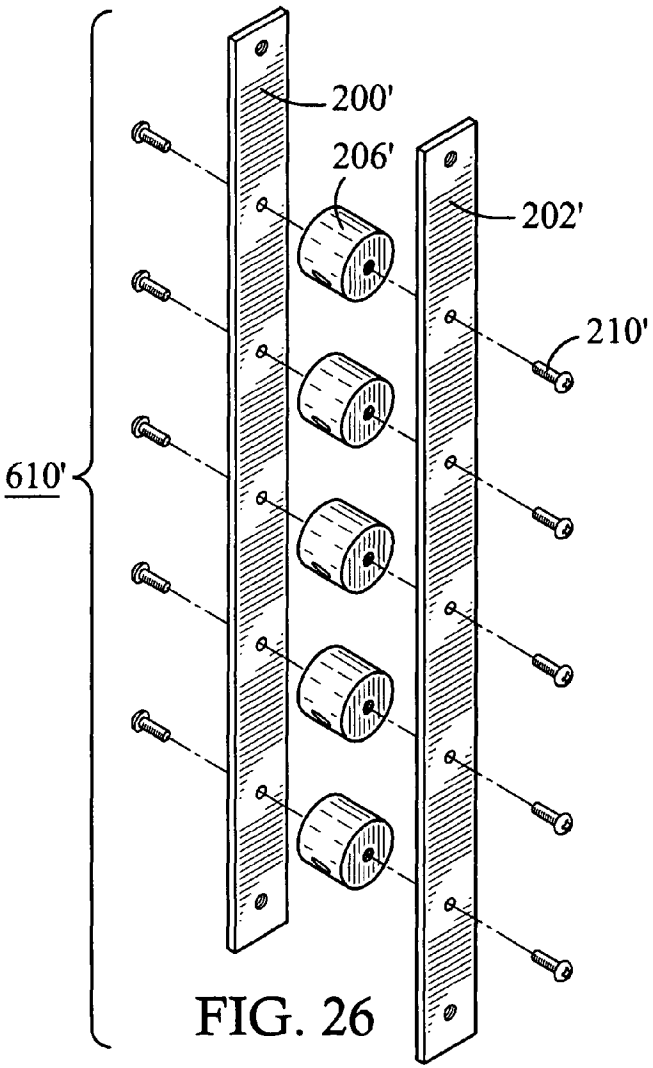
FIGS. 25 and 26 are fragmentary, exploded, isometric views of the alternative embodiments of FIGS. 23 and 24.
Figure 25:
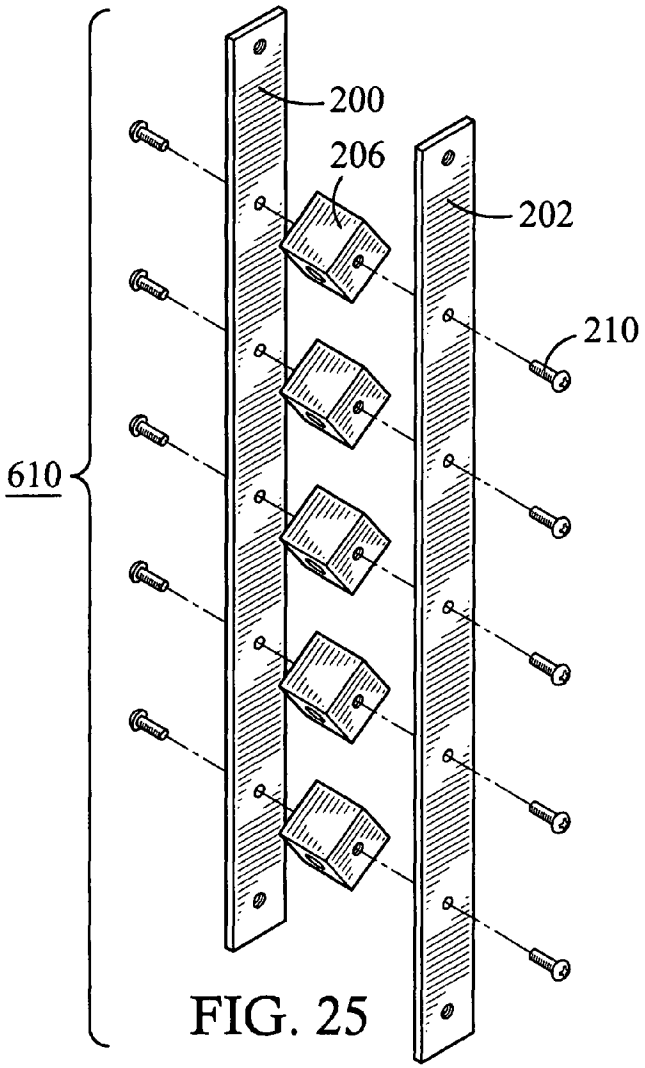

FIGS. 25 and 26 are fragmentary isometric views, respectively, of FIGS. 23 and 24, showing balusters 610 and 610', respectively.

Figure 27A:
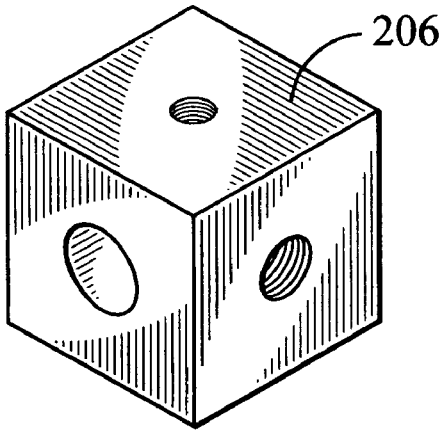
FIGS. 27 and 28 show details of the alternative embodiments of FIGS. 25 and 26.
Figure 27B:
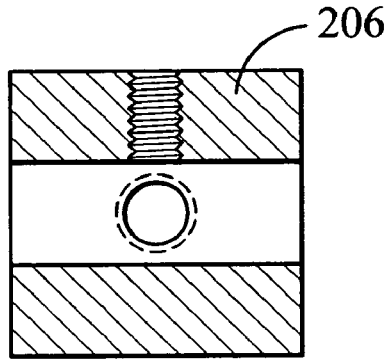

FIGS. 27A and 27B illustrate square member 206 (FIG. 23).

Figure 28A:
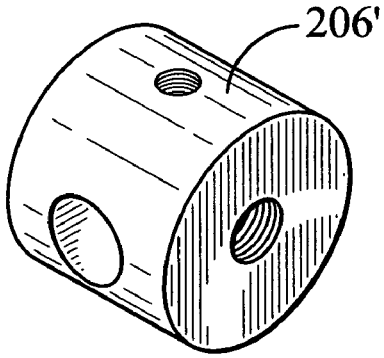
Figure 28B:
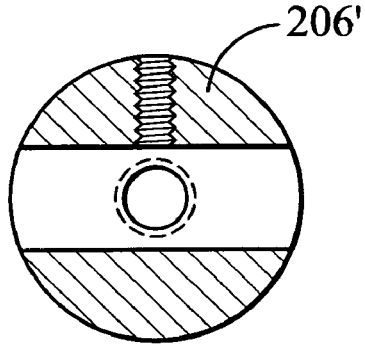

FIGS. 28A and 28B illustrate cylindrical member 206' (FIG. 24).

Figure 29:
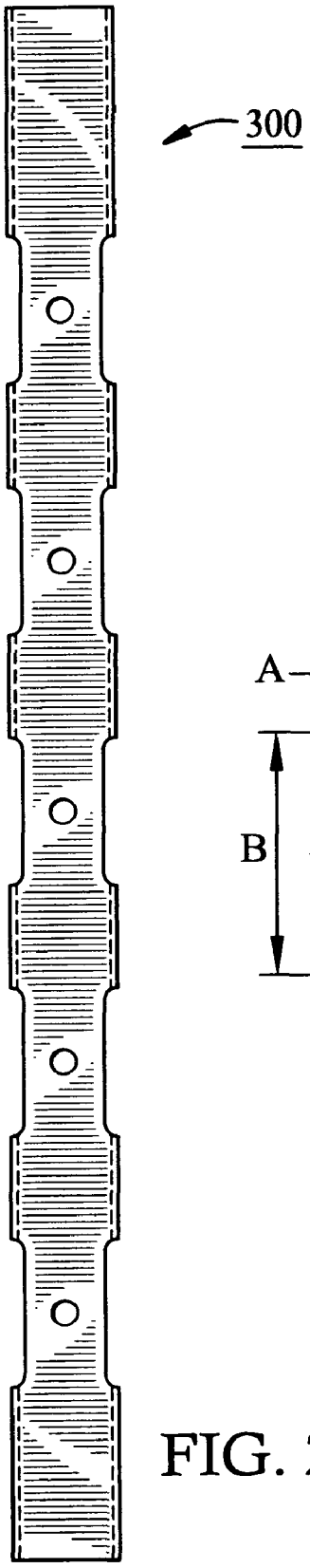
FIG. 29 is a side elevational view of a square baluster.

FIG. 29 illustrates a milled square baluster, generally indicated by the reference numeral 300.

Figure 30:
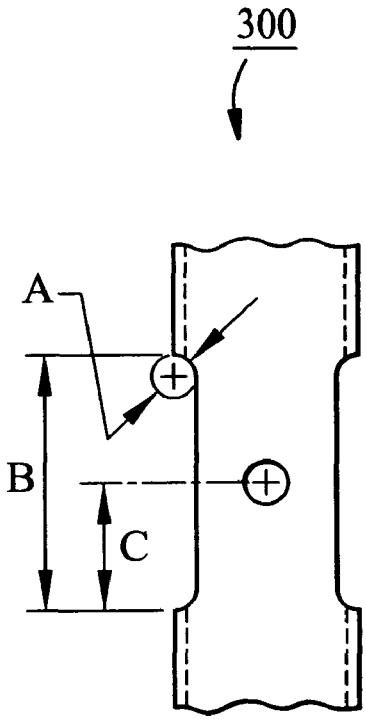
FIG. 30 is a side elevational view showing the milling of the square baluster of FIG. 29.

FIG. 30 illustrates a fragmentary view of a milled, square baluster 300. "A" represents the diameter of the milling cutter (which can vary depending on the diameter of the rails—not shown). "B" is the length of the milled area to accommodate the extreme angle of the rails. "C" shows that the milled area is centered to mount the rail rod nut.

Figure 31:
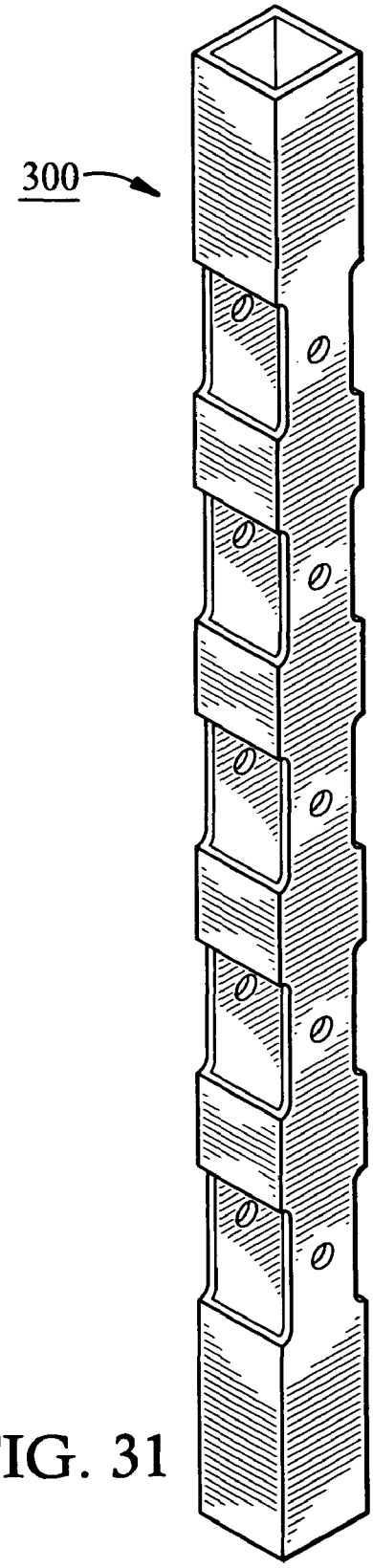
FIG. 31 is an isometric view of the baluster of FIG. 29.

FIG. 31 is an isometric view of square baluster 300 of FIGS. 29 and 30.

Figure 32:
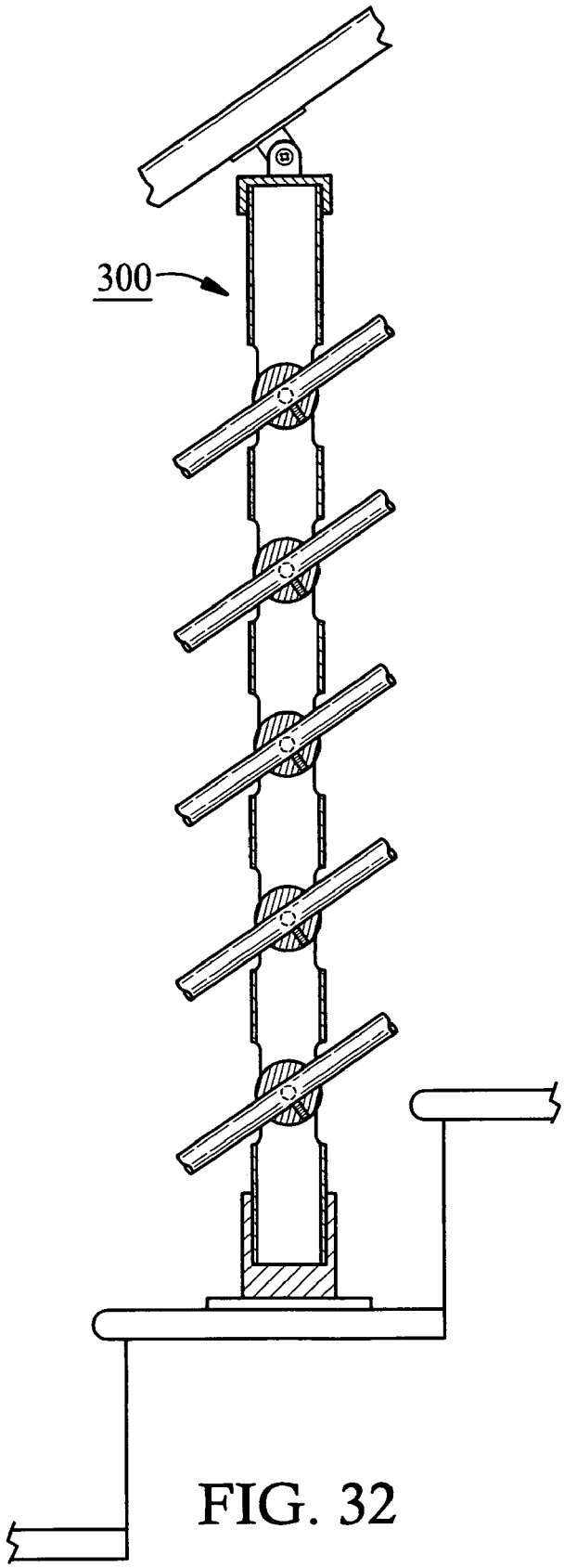
FIG. 32 is a side elevational view of the baluster of FIG. 29, installed in a stair, and with rails inserted therein.
Figure 33:
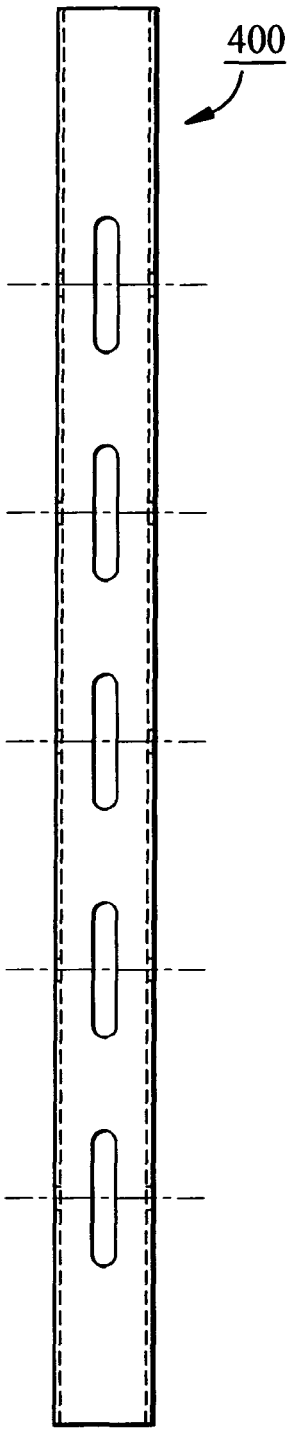
FIG. 33 is a front elevational view.
Figure 34:
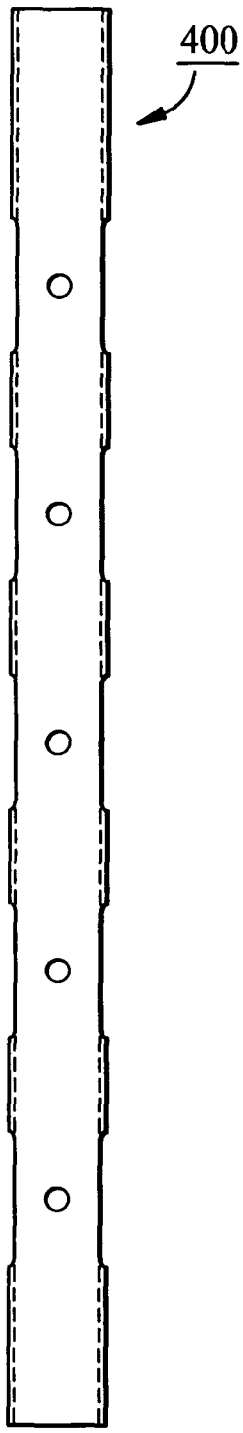
FIG. 34 is a side elevational view.
Figure 35:
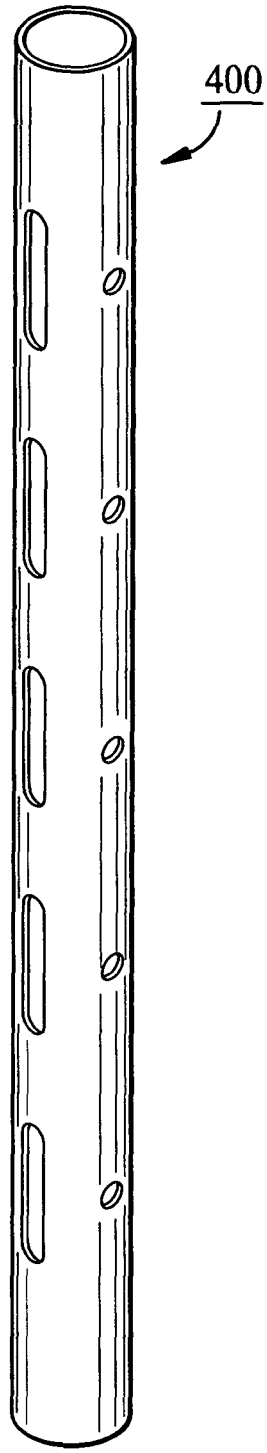
FIG. 35 is an isometric view of a round baluster for the subject invention.
Figure 37:
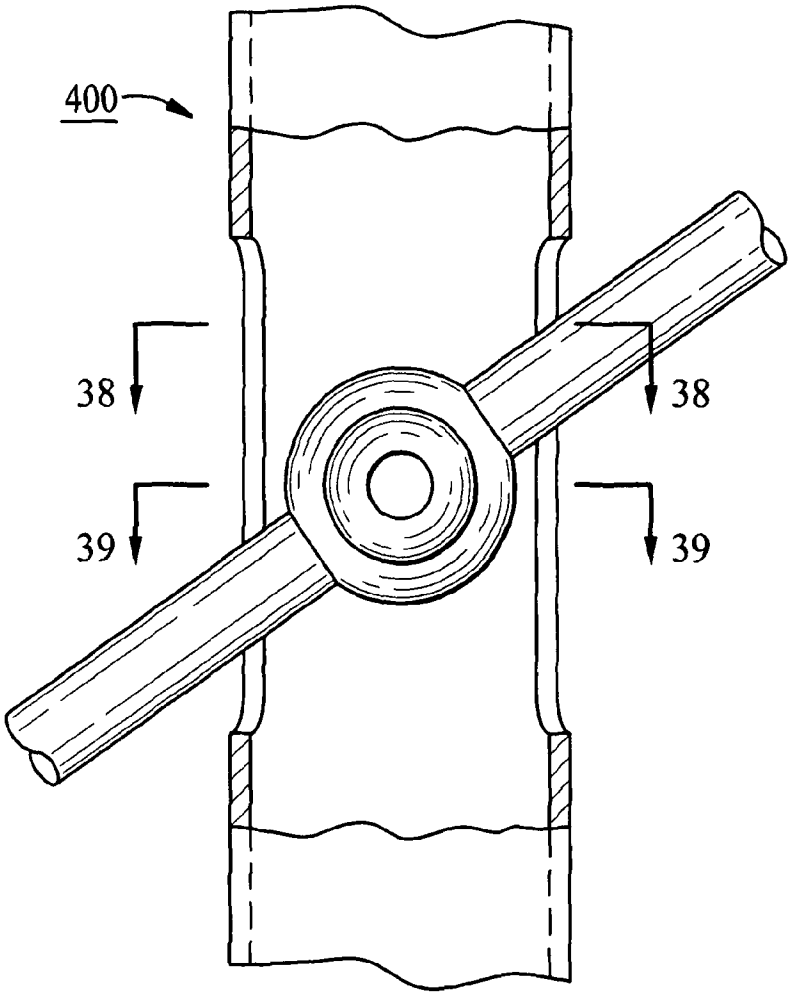
FIG. 37 is a fragmentary view of a ball nut inserted in the round baluster of FIGS. 33-35, partially in cross-section.
Figure 36:
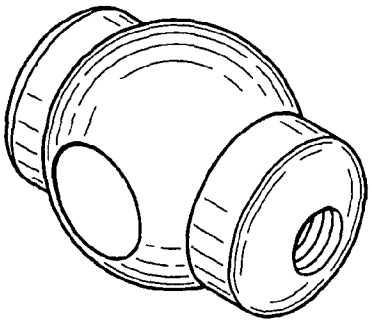
FIG. 36 is an isometric view of a ball nut for use with the round baluster of FIGS. 33-35.
Figure 38:
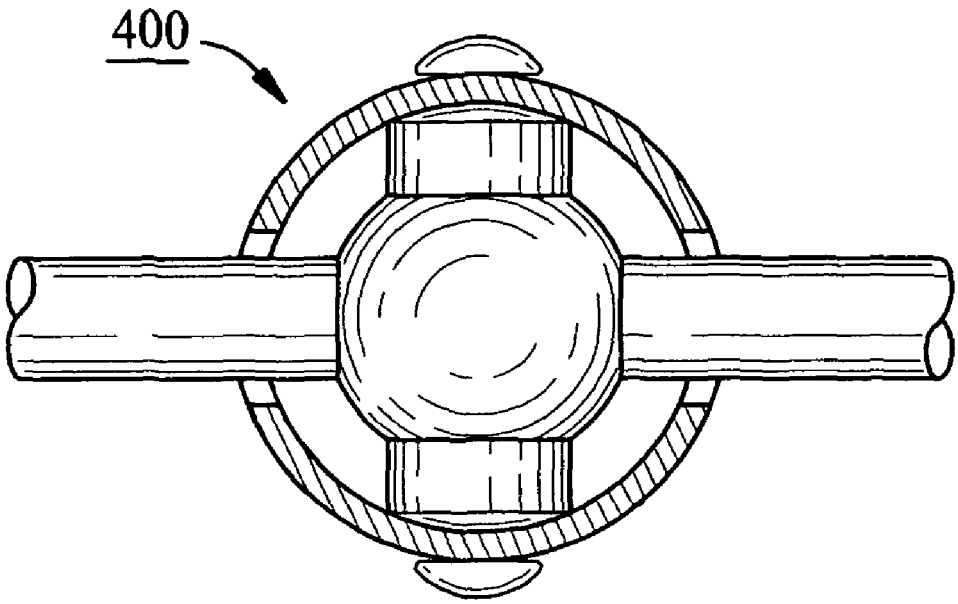
FIG. 38 is a top plan view taken along line "36-36" of FIG. 37.
Figure 39:
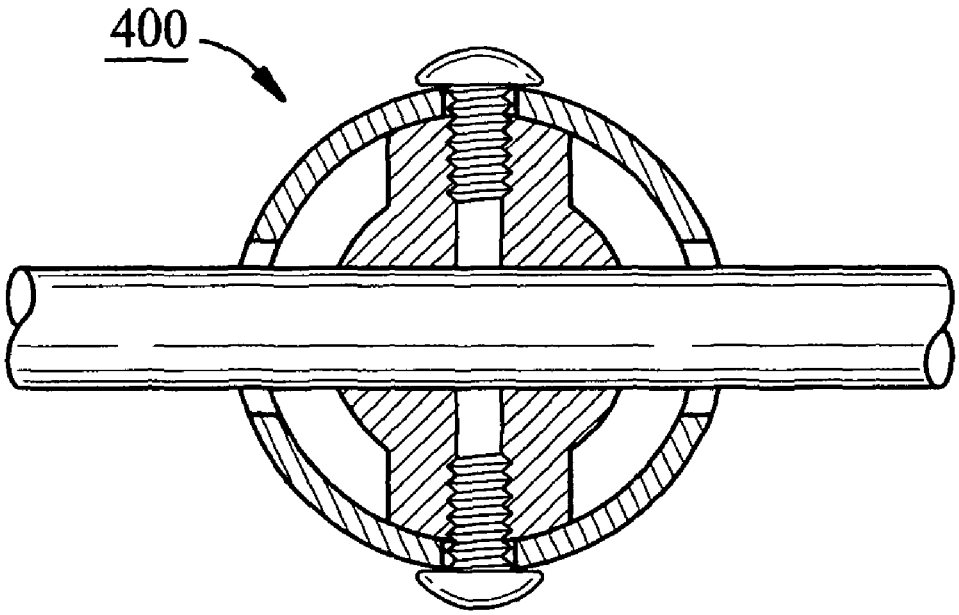
FIG. 39 is a top plan view taken along line "39-39" of FIG. 37.
Figure 40:
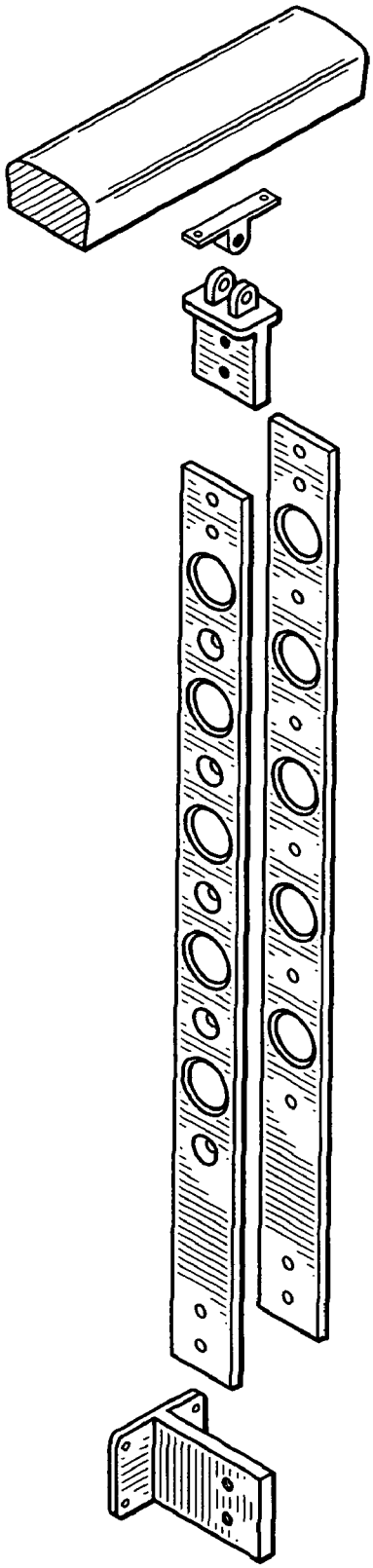
FIG. 40 is an exploded isometric view of one type of "sandwiched" type mounting brackets, with the brackets mounted for an inclined rail and for a vertical mounting surface.
Figure 41:
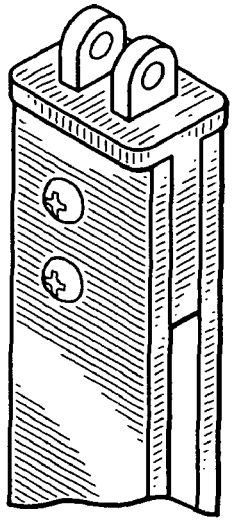
FIGS. 41 and 42 are isometric views of, respectively, top and bottom mounting brackets of the baluster of FIG. 40.
Figure 42:
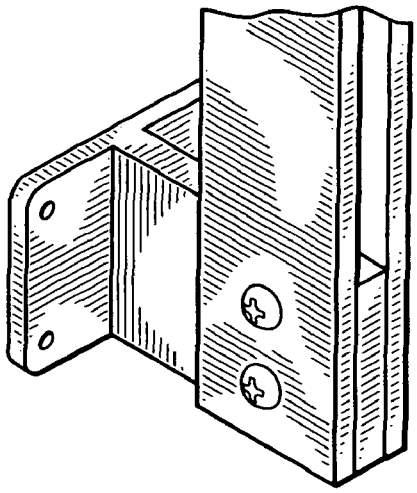
Figure 43:
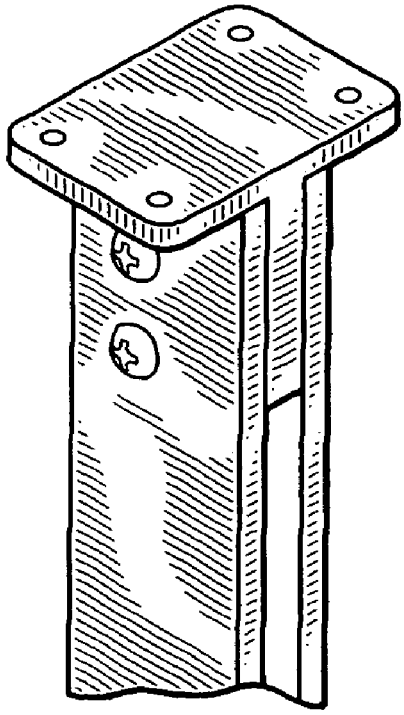
FIGS. 43-63 illustrate various means of mounting the balusters to the rails and to vertical and surface mounting surfaces.
Figure 44:
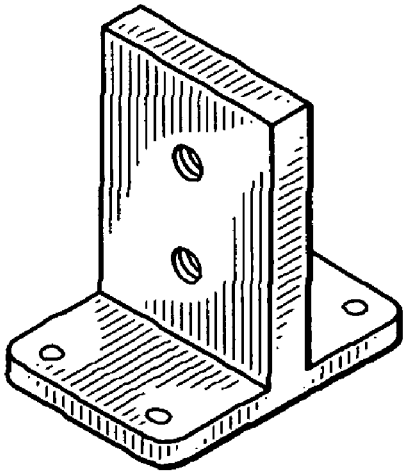
Figure 45:
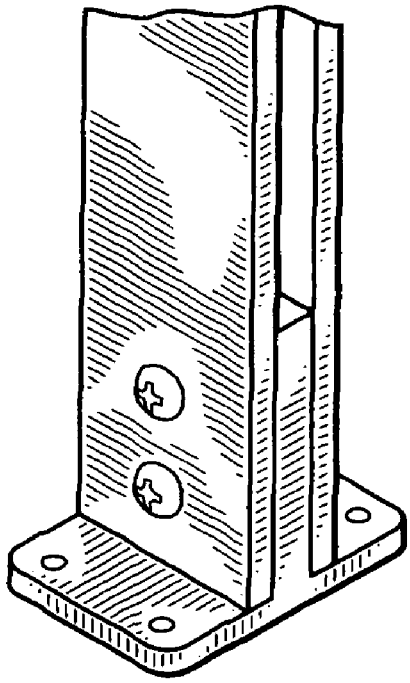
Figure 46:
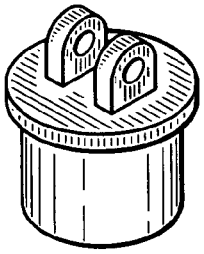
Figure 47:
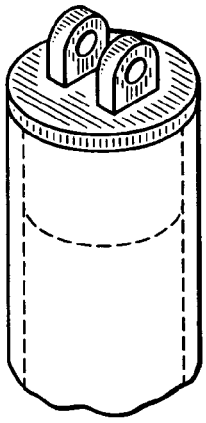
Figure 48:
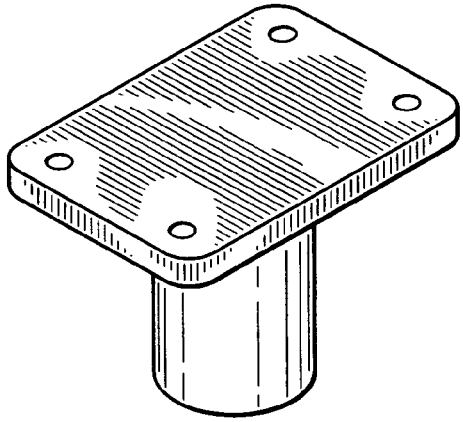
Figure 49:
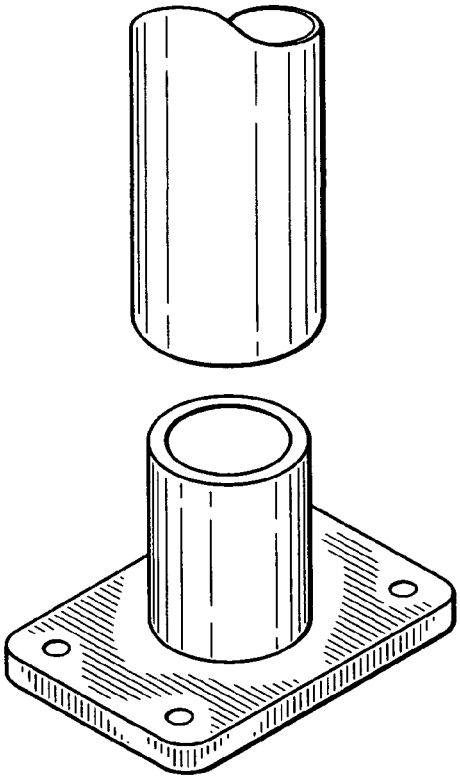
Figure 50:
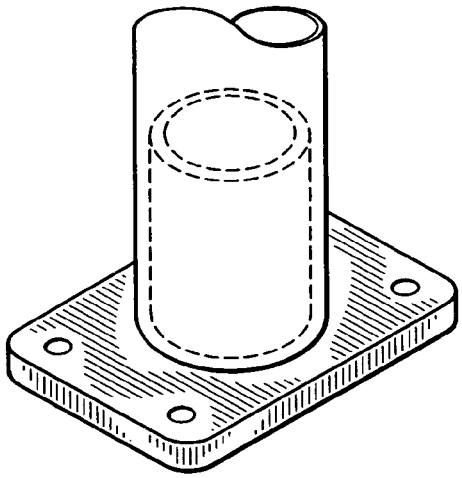
Figure 51:
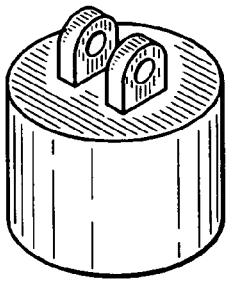
Figure 52:
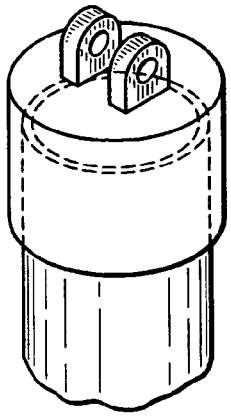
Figure 53:
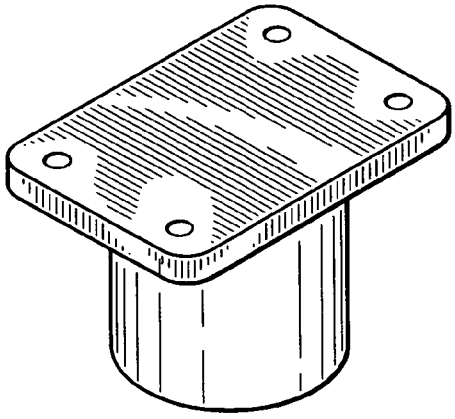
Figure 54:
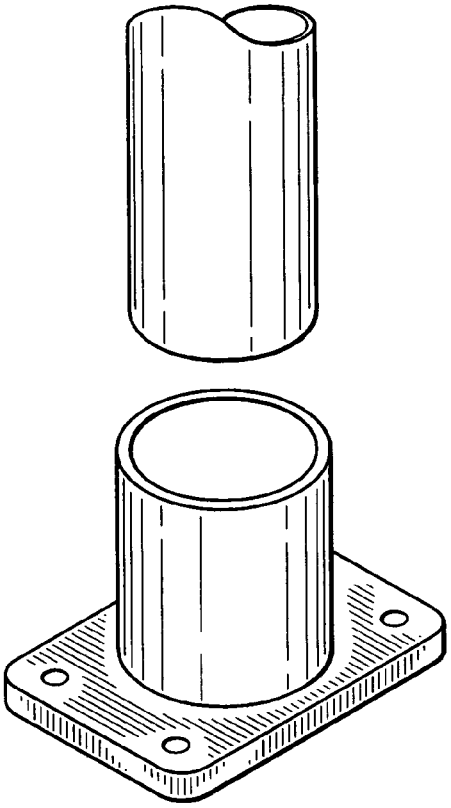
Figure 55:
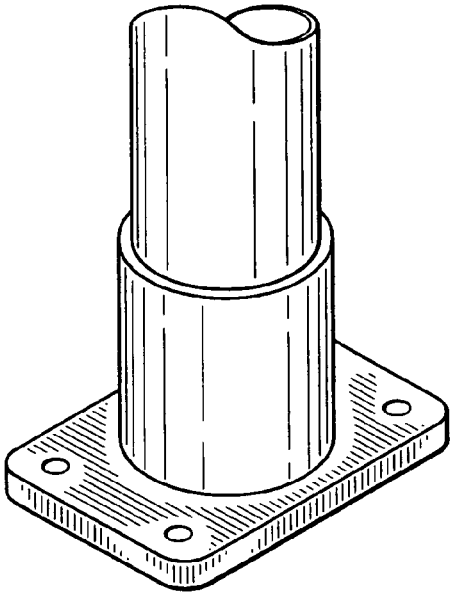
Figure 56:
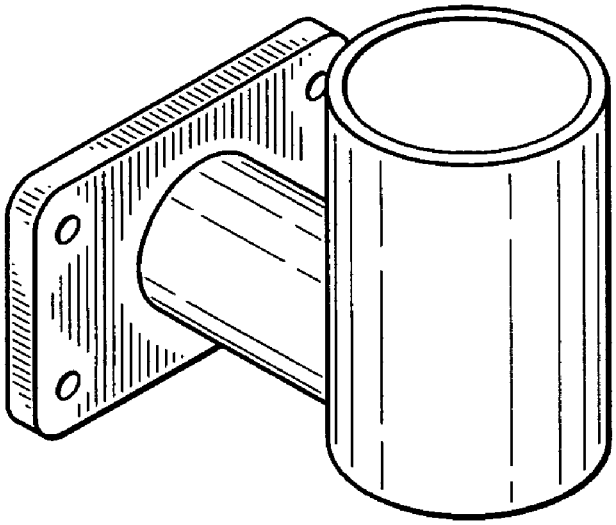
Figure 57:
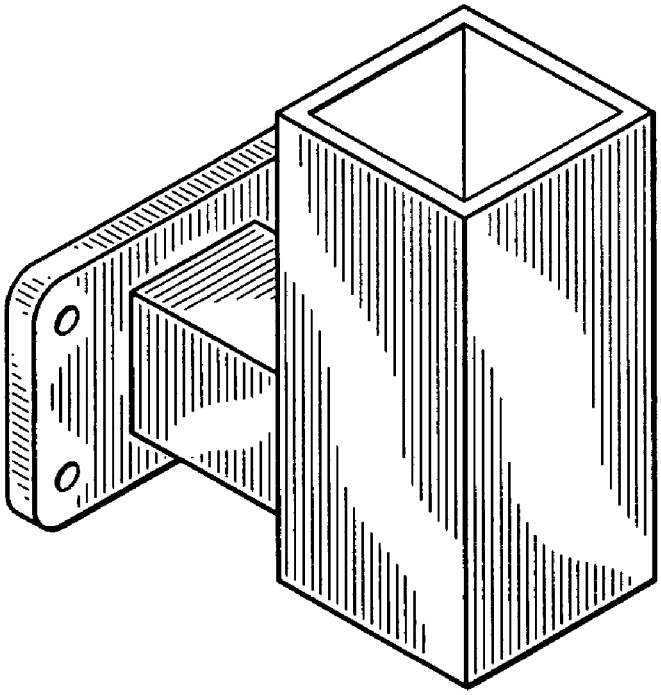
Figure 60:
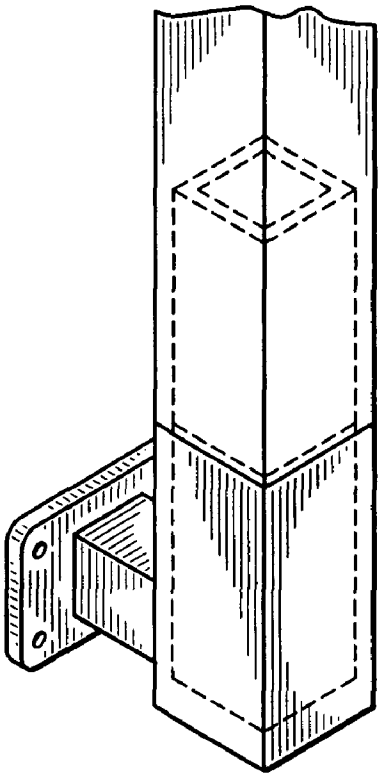
Figure 59:
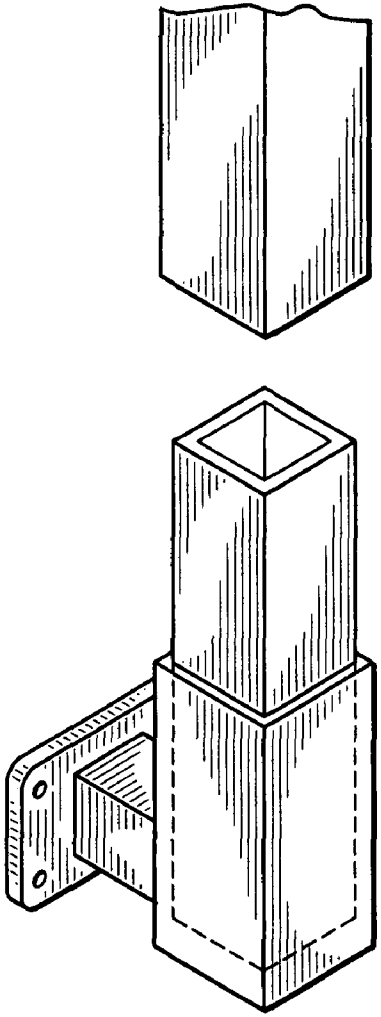
Figure 58:
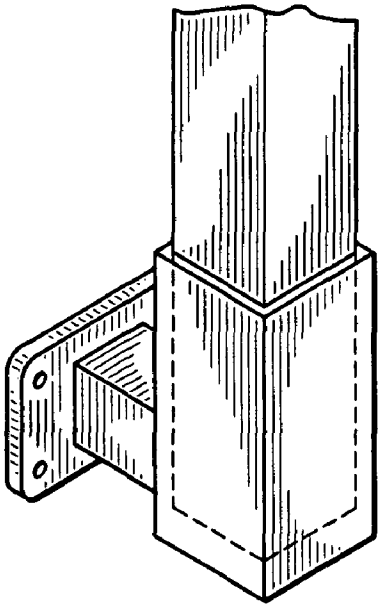
Figure 63:
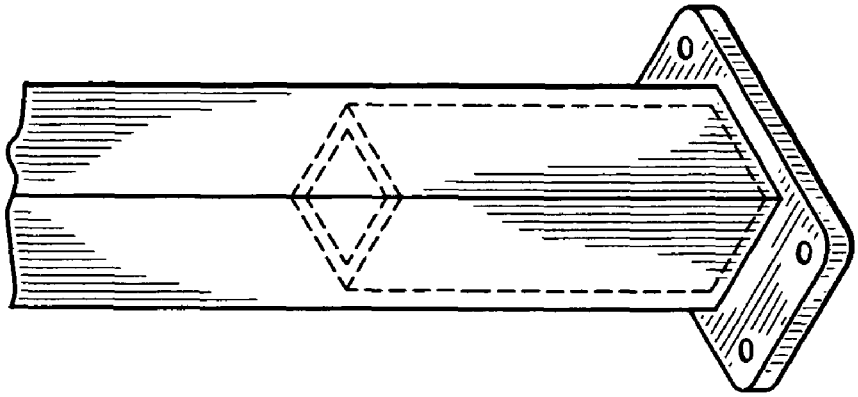
Figure 62:
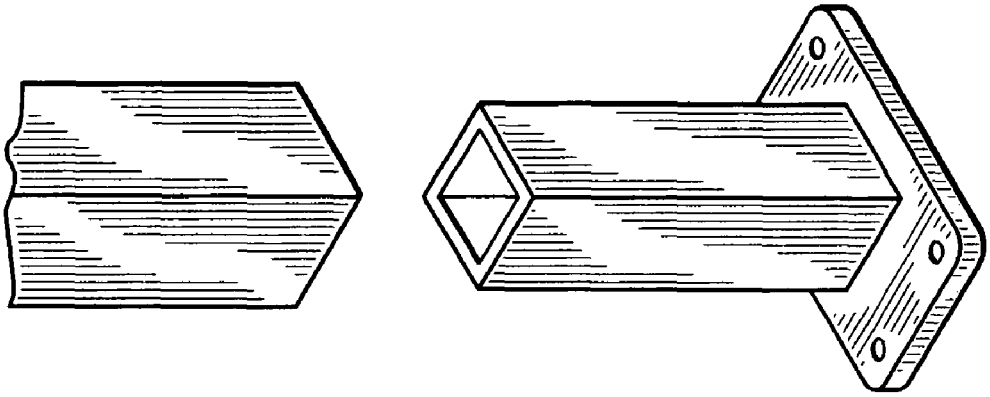
Figure 61:
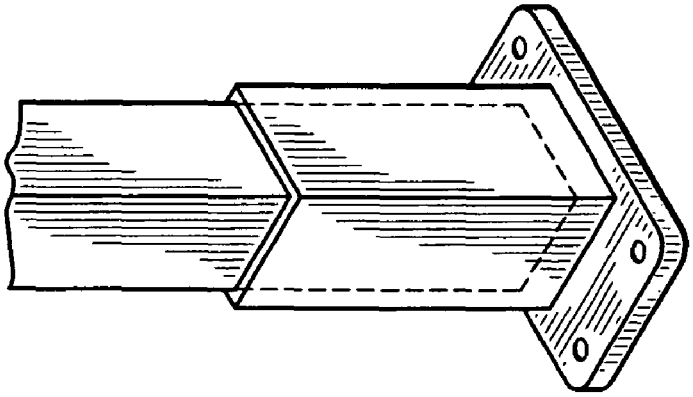

FIG. 32 illustrates square baluster 300 of FIGS. 29-31 installed with rails inserted therein.

FIGS. 33-39 indicate the baluster may be round, generally indicated by the reference numeral 400.

FIGS. 40-63 show the various forms the preceding balusters and their brackets may take.

In the embodiments of the present invention described above, it will be recognized that individual elements and/or features thereof are not necessarily limited to a particular embodiment but, where applicable, are interchangeable and can be used in any selected embodiment even though such may not be specifically shown.

Spatially orienting terms such as "above", "below", "upper"; "lower", "inner", "outer", "inwardly", "outwardly", "vertical", "horizontal", and the like, when used herein, refer to the positions of the respective elements shown on the accompanying drawing figures and the present invention is not necessarily limited to such positions.

It will thus be seen that the objects set forth above, among those elucidated in, or made apparent from, the preceding description, are efficiently attained and, since certain changes may be made in the above construction and/or method without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

The embodiments of the invention in which an exclusive property or privilege is claimed are defined as follows:

1. Apparatus comprising:

a plurality of baluster inserts disposed inside generally vertical balusters, each one of said balusters having a first part comprising a first outer face and an opposing first contact face with a first plurality of apertures transversely extending through said first outer and said first contact faces, and an opposing second part comprising a second outer face and an opposing second contact face with a second plurality of apertures transversely extending through said second outer and said second contact faces, wherein said first and second plurality of apertures form aperture pairs with at least one aperture in said first part of said baluster forming one half of an aperture pair with at least one aperture in the second part of said baluster, each half of each said aperture pair being in physical communication with and disposed on opposing sides of each of said baluster inserts and said respective first and second parts of each said baluster being fixedly attached to an underlying structure such that said respective first and second contact faces face each other;

each one of said plurality of baluster inserts having formed therethrough a hole extending between said opposing sides of said baluster insert;

a plurality of wires, cables, rods, pipes or tubes, each longitudinally extending through a respective one of said apertures of said first plurality of apertures in said first part of each respective said baluster, through said hole of a respective said baluster insert, and through a respective one of said apertures of the second plurality of apertures in said second part of said baluster, said first and second contact faces extending transversely to said longitudinal extension of said wires, cables, rods, pipes or tubes on said opposing sides of said baluster insert; and said baluster inserts being rotatable to position said wires, cables, rods, pipes or tubes selectively horizontally or at an angle from horizontal.

2. Apparatus, as defined in claim 1, wherein said first and second baluster parts are squeezed together by clamping means to secure said baluster inserts in place to prevent further rotation of said baluster inserts.

3. Apparatus, as defined in claim 2, wherein said clamping means includes no spacers between said first and second baluster parts.

4. Apparatus, as defined in claim 2, wherein said clamping means includes screws extending into complementary shaped threads formed on spacers disposed between said first and second baluster parts, said baluster parts having a space therebetween when clamped.

5. Apparatus, as defined in claim 2, wherein: said clamping means includes screws extending between said first and second baluster parts and inside of spacers, said baluster parts having a space therebetween when clamped.

6. Apparatus, as defined in claim 1, wherein said baluster inserts are selected from the group consisting of spheres, squares, and cylinders.

7. Apparatus, as defined in claim 1, wherein said baluster parts are side mounted on a generally vertical surface.

8. Apparatus, as defined in claim 1, wherein said baluster parts are surface mounted on a generally horizontal surface.

9. Apparatus, as defined in claim 1, wherein said baluster inserts are rotatable between 0° and at least 45° from horizontal.

10. Apparatus, as defined in claim 1, wherein said holes are of a diameter larger than the diameter of said wires, cables, rods and tubes, and the difference in said diameters is taken up by one or more bushings.

11. Apparatus, as defined in claim 1, wherein brackets disposed at the tops of said baluster parts allow a handrail to be attached to said baluster parts.

12. Apparatus, as defined in claim 1, wherein said holes are disposed centrally of said baluster inserts.

* * * * *